US010406702B2

(12) United States Patent
Vredeveld et al.

(10) Patent No.: US 10,406,702 B2
(45) Date of Patent: Sep. 10, 2019

(54) BLADE SET, CUTTING APPLIANCE, AND RELATED MANUFACTURING METHOD

(71) Applicant: KONINKLIJKE PHILIPS N.V., Eindhoven (NL)

(72) Inventors: Esther Vredeveld, Eindhoven (NL); Albert Jan Aitink, Eindhoven (NL); Robert Alexander Van Eiberen Santhagens, Eindhoven (NL)

(73) Assignee: KONINKLIIKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/034,222

(22) PCT Filed: Sep. 7, 2015

(86) PCT No.: PCT/EP2015/070314
§ 371 (c)(1),
(2) Date: May 4, 2016

(87) PCT Pub. No.: WO2016/041796
PCT Pub. Date: Mar. 24, 2016

(65) Prior Publication Data

US 2017/0246751 A1 Aug. 31, 2017

(30) Foreign Application Priority Data

Sep. 18, 2014 (EP) ..... 14185272
Mar. 4, 2015 (EP) ..... 15157561

(51) Int. Cl.
*B26B 19/38* (2006.01)
*B26B 19/06* (2006.01)

(52) U.S. Cl.
CPC ..... *B26B 19/3846* (2013.01); *B26B 19/06* (2013.01); *B26B 19/3893* (2013.01)

(58) Field of Classification Search
CPC ..... B26B 19/00; B26B 19/04; B26B 19/06; B26B 19/063; B26B 19/02; B26B 19/066; B26B 19/3846; B26B 19/3893
(Continued)

(56) References Cited

U.S. PATENT DOCUMENTS 2,915,816 A * 12/1959 Gray ..... B26B 19/042 30/346.51
2,948,063 A * 8/1960 Jepson ..... B26B 19/042 30/34.1
(Continued)

FOREIGN PATENT DOCUMENTS

EP 0111372 A2 * 6/1984 ..... B62B 19/06
EP 0282117 A1 * 9/1988 ..... B26B 19/06
(Continued)

*Primary Examiner* — Jason Daniel Prone

(57) ABSTRACT

A cutting appliance, system, method and manufacturing process related to a blade set, a cutter and a stationary blade for the blade set. The cutter includes a main portion, such as a substantially flat main portion obtained from sheet metal material, at least one toothed leading edge protruding from the main portion. The at least one toothed leading edge includes at least two teeth and at least one scraping portion including a tapered scraper profile at least partially extending in a longitudinal direction that is perpendicular to a cutting motion direction of the cutter. The at least one scraping portion may be, in a mounted state, arranged to contact a stationary blade of the blade set at a first wall thereof to scrape off accumulated dirt and debris when the cutter and the stationary blade are moved with respect to each other when in operation.

14 Claims, 16 Drawing Sheets

(58) Field of Classification Search
USPC ..... 30/43.7–43.92, 346.5, 346.51, 346.57, 30/346.59, 351, 353
See application file for complete search history.

(56) References Cited

U.S. PATENT DOCUMENTS

| | | | | |
|---|---|---|---|---|
| 4,577,408 | A * | 3/1986 | Tietjens | B26B 19/06 30/43.92 |
| 6,418,622 | B2 * | 7/2002 | Garenfeld | B26B 21/38 30/43.92 |
| 7,913,399 | B2 * | 3/2011 | Lau | B26B 19/06 30/43.92 |
| 8,132,332 | B2 * | 3/2012 | Tautscher | B26B 19/3846 30/43.92 |
| 8,806,757 | B2 * | 8/2014 | Moseman | B26B 19/205 30/43.92 |
| 9,027,252 | B2 * | 5/2015 | Moseman | B26B 19/3846 30/43.92 |
| 9,381,655 | B2 * | 7/2016 | Lau | B26B 19/06 |
| 9,381,656 | B2 * | 7/2016 | Van Straaten | B26B 19/06 |
| 9,873,203 | B2 * | 1/2018 | Stapelbroek | B26B 19/06 |
| 10,081,114 | B2 * | 9/2018 | Sablatschan | B26B 19/3846 |
| 2006/0042096 | A1 * | 3/2006 | Liao | B26B 19/06 30/223 |
| 2006/0156549 | A1 * | 7/2006 | O | B26B 19/3846 30/43.91 |
| 2010/0299937 | A1 * | 12/2010 | Geiser | B26B 19/06 30/233.5 |
| 2011/0119929 | A1 | 5/2011 | Lau | |
| 2016/0059428 | A1 * | 3/2016 | Lau | B26B 19/06 30/30 |
| 2016/0229072 | A1 * | 8/2016 | Stapelbroek | B26B 19/06 |
| 2016/0236362 | A1 * | 8/2016 | Stapelbroek | B26B 19/3846 |
| 2016/0236363 | A1 * | 8/2016 | Stapelbroek | B26B 19/3846 |
| 2016/0271814 | A1 * | 9/2016 | Bennik | B26B 19/06 |
| 2017/0028574 | A1 * | 2/2017 | Iaccarino | B26B 19/20 |
| 2017/0028576 | A1 * | 2/2017 | Sablatschan | B26B 19/042 |
| 2017/0113361 | A1 * | 4/2017 | Feijen | B26B 19/3846 |
| 2017/0120466 | A1 * | 5/2017 | Phoon | B26B 19/28 |
| 2017/0144319 | A1 * | 5/2017 | Sablatschan | B26B 19/042 |
| 2017/0190063 | A1 * | 7/2017 | Schratter | B26B 19/042 |
| 2017/0246751 | A1 | 8/2017 | Vredeveld | |
| 2017/0259439 | A1 * | 9/2017 | Van Eibergen Santhagens | B26B 19/06 |
| 2017/0348865 | A1 * | 12/2017 | Werner | B26B 19/06 |
| 2018/0009121 | A1 * | 1/2018 | Stapelbroek | B26B 19/3846 |
| 2018/0099427 | A1 * | 4/2018 | Huisman | B26B 19/3846 |
| 2018/0104834 | A1 * | 4/2018 | Zuidervaart | B26B 19/3846 |
| 2018/0141223 | A1 * | 5/2018 | Lau | B26B 19/06 |
| 2018/0257248 | A1 * | 9/2018 | Wu | B26B 19/063 |
| 2018/0281213 | A1 * | 10/2018 | Eijkelkamp | B26B 19/063 |

FOREIGN PATENT DOCUMENTS

| | | | |
|---|---|---|---|
| EP | 1974875 | A1 * | 10/2008 |
| GB | 2295116 | A | 5/1996 |
| WO | 2013150412 | A1 | 10/2013 |

* cited by examiner

BLADE SET, CUTTING APPLIANCE, AND RELATED MANUFACTURING METHOD

This application is the U.S. National Phase application under 35 U.S.C. § 371 of International Application No. PCT/EP2015/070314, filed on Sep. 7, 2015, which claims the benefit of International Application No. 14185272.3 filed on Sep. 18, 2014 and International Application No. 15157561.0 filed on Mar. 4, 2015. These applications are hereby incorporated by reference herein.

FIELD OF THE INVENTION

The present disclosure relates to a (hair) cutting appliance, particularly to a cutter and a stationary blade of a blade set for such an appliance. The present disclosure further relates to corresponding manufacturing methods.

BACKGROUND OF THE INVENTION

WO 2013/150412 A1 discloses a cutting appliance and a corresponding blade set of a cutting appliance. The blade set comprises a stationary blade and a movable blade, wherein the movable blade can be reciprocatingly driven with respect to the stationary blade for cutting hair.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

Common electric razors are not particularly suited for cutting hair to a desired variable length above the skin, i.e., for precise trimming operations. Similarly, common hair trimmers are not particularly suited for shaving. Furthermore, combined shaving and trimming devices show several drawbacks since they basically require two cutting blade sets and respective drive mechanisms.

The above WO 2013/150412 A1 tackles some of these drawbacks by providing a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

However, there is still a need for improvement in hair cutting devices and respective blade sets. This may particularly involve user comfort related aspects, performance related aspects, and manufacturing related aspects. Manufacturing related aspects may involve suitability for series production or mass production.

SUMMARY OF THE INVENTION

It is an object of the present disclosure to provide an alternative stationary cutter blade, and a corresponding blade set that that contribute to a pleasant user experience in both shaving and trimming operations. More preferably, the present disclosure may address at least some drawbacks inherent in known prior art hair cutting blades as discussed above, for instance. It would be further advantageous to provide for a blade set that may exhibit an improved operating performance while preferably reducing the time required for cutting operations. It is preferred desired to present an adequate corresponding manufacturing method.

According to a first aspect of the present disclosure, a cutter for a blade set of a hair cutting appliance according to claim 1 is presented. As used herein, the cutter may be referred to as movable cutter blade.

According to another aspect of the disclosure a blade set for a cutting appliance according to claim 10 is presented.

According to another aspect of the disclosure a method of manufacturing a blade set for a cutting appliance according to claim 12 is presented.

The cutter-related aspect is based on the insight that the at least one scraping portion may act as a scraper or pusher when the cutter and the stationary blade are moved with respect to each other so as to remove accumulated dirt and debris, such as hair remainders, etc. from the guide slot. This is particularly beneficial when the cutter is mounted at a stationary blade that is arranged as a double-walled stationary blade which at least partially encompasses and guards the cutter at two opposite sides thereof. Since the stationary blade according to at least some embodiments of the present disclosure comprises a first wall and a second wall that define therebetween the guide slot for the cutter, the guide slot as such is hard to reach and therefore hardly accessible for a manual cleaning operation. Generally, the first wall may be referred to as first wall portion. Generally, the second wall may be referred to as second wall portion. Further, as it is preferred that the cutter is arranged in the guide slot in a defined manner without considerable (vertical) play, providing the cutter with sufficient dirt removing capabilities may further improve the long-time performance of the blade set. Generally, the scraper profile may also be referred to as pusher profile. Further, the relatively flat main portion of the cutter may also be referred to as planar main portion.

As a consequence, the cutter that is provided with at least one scraping portion itself may clean the guide slot and remove the deposits and accumulations. Consequently, long-term performance and operational life span of the blade set may be increased. At least to some extent, the blade set that is fitted with a respective cutter may provide self-cleaning capabilities.

In one embodiment of a cutter, the tapered scraper profile of the at least one scraping portion is arranged as a longitudinally extending pointed profile comprising a tip edge at the side of the cutter that is facing the first wall in the mounted state. Hence, the tapered scraper profile may be arranged at the cutting surface where respective cutting edges of the stationary blade and the cutter cooperate with each other. Consequently, hair remainders and further particles that may be generated and accumulated at the very cutting spot may be removed in this way. As a consequence, those particles can be prevented from sticking on in the guide slot which might for instance increase frictional effects between the cutter and the stationary blade when the blade set is operated.

In another embodiment of the cutter, the scraper profile of the at least one scraping portion comprises a cross-section selected from the group consisting of wedge shape, triangle shape, C-shape, double wedge shape, and double triangle shape. Generally, it is preferred that a relatively sharp tip is provided at the profile of the at least one scraping portion. In case a profile is implemented that comprises two respective tip edges, a first and a second tip edge may be provided at opposite sides of the cutter so as to contact and clean the first wall and the second wall of the stationary blade. It may be preferred that the cross-section of the tapered scraper profile comprises an acute angle so as to form the relatively sharp tip edge.

Generally, the tip edge may be defined by an angle of inclination β (beta) between a side of the profile that is basically parallel to a longitudinal direction Y and a side that is inclined thereto. The angle may be in the range of about 5° (degrees) to about 60°, preferably in the range of about 15° to about 45°, more preferably in the range of about 22.5° to about 30°. However, at least in some embodiments, the side of the cross-section of the tapered scraper profile that is inclined with respect to the side that is basically parallel to the lateral direction Y may be at least partially curved, for instance convexly curved or concavely curved.

In another embodiment of the cutter that is fitted with at least one scraping portion, the cutter further comprises a guide opening, particularly a laterally extending slot, wherein the at least one scraping portion is formed at a respective lateral end surface of the guide opening. Preferably, the guide opening or guide slot is arranged to encompass an intermediate wall of a stationary blade of the blade set. In a further embodiment of the cutter, a first scraping portion is formed at a first lateral end and a second scraping portion is formed at a second lateral end of the guide opening, wherein the first scraping portion and the second scraping portion are facing each other. Generally, the intermediate wall may be referred to as intermediate wall portion.

At least in some embodiments, the cutter is reciprocatingly driven with respect to the stationary blade. Consequently, the stationary blade may be oscillatingly driven in a back and forth fashion. By providing a first scraping portion and a second scraping portion that is opposite to the first scraping portion, each direction of a single stroke of the cutter may be used for the cleaning action. Further, the first scraping portion and the second scraping portion may be arranged as basically inwardly facing scraping portions at the guide opening. Therefore, the relatively sharp tips of the scraping portion are hardly accessible for a user of the blade set. Hence, even though relatively sharp edges are provided, the risk of injuries for the (end) user is considerably low.

In a refinement of the guide opening-implementing embodiment, at least one scraping portion at the lateral end surface of the guide opening is arranged as an interrupted scraping portion comprising at least two sections, wherein an inwardly protruding abutment tab is arranged between the sections. Particular in embodiments of the blade set wherein the stationary blade thereof is fitted with an intermediate wall that is arranged between the first wall and the second wall and that is at least partially extending through the guide opening, the protruding abutment tab may protect the tip edge. More particularly, the protruding abutment tab may prevent the tip edge of the scraper profile from contacting the intermediate wall. Preferably, a first protruding abutment tab is provided at the first lateral end and a second protruding abutment tab is provided at the second lateral end of the guide opening.

In a further embodiment of the cutter that is provided with at least one scraping portion, at least one respective scraping portion is provided that comprises a tapered scraper profile including a first tip edge and a second tip edge, wherein the first tip edge is arranged at a first, skin-facing surface of the cutter, and wherein the second tip edge is arranged at a second surface of the cutter that is facing away from the skin, when in operation. As indicated above, such a scraping portion may comprise a scraper profile having a cross-section that may be selected from the group consisting of C-shape, double-wedge shape and double-triangle shape. Consequently, the cutter may be arranged to scrape off accumulations at both the first wall and a second wall of the stationary blade. To this end, in a further refinement of this embodiment, the first tip edge is associated with the first wall and the second tip edge is associated with the second wall of the stationary blade.

In another embodiment of the cutter that is fitted with at least one scraping portion, a plurality of similarly oriented scraping portions is provided that are laterally displaced from one another, wherein an offset between the scraping portions is adapted to an expected stroke of the cutter. Consequently, a large portion of the stationary blade may be cleaned by the cutter. As used herein, similarly oriented scraping portions are provided with tip edges that are arranged at the same side of the cutter, preferably the top side or surface of the cutter that is facing the first wall of the stationary blade in a mounted state. Further, similarly oriented scraping portions may be arranged in the same fashion with respect to the lateral extension of the cutter, i.e. not facing each other. Consequently, a first number of similarly oriented scraping portions and a second number of similarly oriented scraping portions may be provided, wherein the two groups of scraping portions are facing each other. For instance, two or more scraping portions of a first type and two or more scraping portions of a second type of scraping portions may be provided.

By way of example, an offset between respective ones of the plurality of similarly oriented scraping portions may be defined to correspond to or be at least slightly smaller than an expected stroke of the cutter in the operational state. Consequently, at least a certain portion of the first wall and/or the second wall of the stationary blade may be cleaned.

In another embodiment of the cutter according to the above aspect, at least one outwardly-facing scraping portion is provided at a lateral end portion of the cutter. Preferably, a first outwardly-facing scraping portion is provided at a first lateral end and a second outwardly-facing scraping portion is provided at a second lateral end of the cutter.

In another embodiment of this aspect, the cutter is further provided with a plurality of scraping portions that are laterally displaced from one another and that are oriented in an opposite fashion. As used herein, the term opposite fashion shall primarily relate to the vertical orientation of the tip edges of the respective scraping portions. Hence, a first type of scraping portions may be provided with tip edges that are arranged to contact the first wall. Further, a second type of scraping portions may be provided with tip edges that are arranged to contact the second wall of the blade set.

Generally, the scraping portions may be processed and/or manufactured by machining processes that are similar or correspond to the machining processes that are utilized to form the teeth of the cutter. By way of example, etching processes, more generally, electro-chemical machining processes may be utilized. Further, also a combination of stamping and etching may be used. More generally, appropriate material-removing processes may be used to define and form the at least one scraping portion including the respective tip edge.

According to a further aspect of the present disclosure, a stationary blade for a blade set of a cutting appliance is presented, said blade set being arranged to be moved through hair in a moving direction to cut hair, said stationary blade comprising:

a first wall arranged to serve as a skin facing wall when in operation, a second wall at least partially offset from the first wall, such that the first wall and the second wall define therebetween a guide slot arranged to receive a cutter, at least one toothed leading edge jointly formed by the first wall and the second wall, wherein the at least one toothed leading edge comprises a plurality of teeth, and wherein the first wall and the second wall are connected at a frontal end of the at least one toothed leading edge, thereby forming tips of the teeth.

Preferably, the stationary blade according to this aspect cooperates with a cutter according to another aspect of the present disclosure which will be further described hereinafter.

According to one embodiment of this aspect, the stationary blade is an integrally formed metal-plastic composite stationary blade, wherein the first wall is at least partially made from metal material, and wherein the second wall is at least partially made from plastic material.

According to another embodiment, the stationary blade further comprises an intermediate wall arranged between a first wall and a second wall, wherein the intermediate wall defines a central offset between the first wall and the second wall, and wherein the intermediate wall is adapted to a respective opening with a to-be-mounted cutter.

According to another embodiment the stationary blade further comprises cutteran intermediate wall arranged between the first wall and the second wall, wherein the intermediate wall defines a central offset $l_{co}$ between the first wall and the second wall, and wherein the intermediate wall is adapted to a respective opening of a to-be-mounted cutter.

According to another aspect of the disclosure, the stationary blade is arranged as an integrally formed metal-plastic composite stationary blade, wherein the first wall is at least partially made from metal material, and wherein the second wall is at least partially made from plastic material.

Some of the stationary blade-related embodiments are based on the insight that the first wall which may be in close contact with the skin, and which is basically configured to cooperate with a cutter to cut hair preferably exhibits considerable stiffness and robustness properties. The first wall is at least partially made from metal material, particularly from steel material such as stainless steel, for instance. Consequently, even though the first wall is preferably considerably thin-walled so as to allow cutting hairs close to the skin, it may provide adequate strength. Furthermore, the second wall may be added at the side typically facing away from the skin to further strengthen the stationary blade. Preferably, the stationary blade may be obtained from a combined manufacturing process which involves forming the plastic material and bonding the plastic material to the metal material, basically at the same time. It is particularly preferred that the stationary blade consists of the first wall and the second wall, i.e. no further essential components need to be mounted thereto to accomplish the stationary blade. Generally, the stationary blade may be regarded as a two-component part wherein the two components are integrally and fixedly interconnected.

However, according to the above embodiment, the stationary blade—in its final state—may provide even further functions. In addition to the first wall and the second wall an intermediate wall may be present which preferably further stiffens the stationary blade. As a consequence, the first wall may be shaped even thinner without facing the risk of an increased flexing tendency. Hence, the intermediate wall may serve as a backbone that may connect the first wall and the second wall. So the first wall and the second wall may be connected at their leading edge(s) and in addition in a further area where the intermediate wall is arranged. This may greatly improve the strength of the stationary blade and a respective blade set.

The intermediate wall may further define (or: set) the central offset between the first wall and the second wall at high accuracy. This may be further beneficial since it is intended at least in some embodiments to receive the cutter without additional biasing by pretensioning members in the guide slot of the stationary blade. In conventional blade sets, typically spring elements are provided to ensure a tight fit of the respective teeth of the stationary blade and the cutter. Generally, the cutter is at least slightly biased towards the stationary blade so as to achieve a desired clearance or contact at the toothed leading edges. Generally, a considerably small gap at a contact region is desirable. If the gap would be too big, cutting performance would be decreased. If the gap would be too small, higher contact pressure and increased friction would occur. This would also increase power consumption and heat generation. It is therefore beneficial that the intermediate wall may set an offset distance between the first wall and the second wall which may have a positive effect on the accuracy and the precision of the desired gap at the contact region between the teeth of the stationary blade and the movable blade.

The intermediate wall may be further adapted to an opening in the cutter which may also be referred to as guide opening or opening guide slot. Hence, the cutter may be received and guided by the intermediate wall. This may improve the setting of the longitudinal position of the cutter with respect to the stationary blade. Hence, not only the vertical gap (or: height gap) at the contact region but also the longitudinal alignment of the respective teeth of the toothed leading edges may be defined by the structure of the stationary blade as such at high accuracy and precision. This may have the further advantage that power transmission to the cutter may be even further simplified since respective coupling members and/or transmission members do not have to provide this function as well. By contrast, the drive train of the cutting appliance may be suitably designed to set the cutter into motion with respect to the stationary blade without having to consider huge direct impacts on the longitudinal guide of the cutter. Hence, the design of the drive train may be focused on its primary function—power transmission.

In one embodiment, the intermediate wall is fixedly attached to the first wall, particularly to a metal surface thereof. This may further strengthen the stationary blade. It is generally preferred in this context that the intermediate wall and the first wall are made from a similar material, at least at their contact surface.

In one embodiment, the intermediate wall is made from metal material, particularly from sheet metal material. Hence, the intermediate wall may exhibit a considerable wear resistance. Further, the intermediate wall may exhibit a considerable heat transfer capacity.

In one embodiment, the intermediate wall is bonded, particularly laser-welded to the first wall. Bonding may generally involve soldering and welding. Welding may involve spot welding. It is preferred that the intermediate wall is laser-spot-welded to the first wall.

In one embodiment, the intermediate wall contacts the second wall, particularly a plastic surface thereof. This may involve that the intermediate wall abuts the second wall. Generally the intermediate wall may act as a gage for defining the central offset $l_{co}$ between the first wall and the second wall. Consequently, the height of the intermediate wall may correspond to the central offset $l_{co}$. The intermediate wall may be at least slightly pre-tensioned between the first wall and the second wall due to a tight fit mating. Hence, the position of the intermediate wall may be defined even more precisely. A contact and/or abutment of the intermediate wall at the second wall does not necessarily involve that the intermediate wall is actually firmly fixed and/or bonded to the second wall. Since the intermediate wall is preferably firmly fixed to the first wall, and since the first wall and the second wall may be integrally formed and bonded, the stationary blade as such may be well-defined and sufficiently rigid.

In one embodiment, the stationary blade comprises a metal component, particularly a sheet metal insert, and a plastic component bonded to the metal component, wherein at least a central portion of the first wall is formed by the metal component. This may have the advantage that the metal component may be particularly thin which may allow cutting hairs very close to the skin of a user. Consequently, shaving performance may be improved.

In one embodiment, the metal component further comprises tooth stem portions comprising cutting edges that are configured to cooperate with cutting edges of respective teeth of the cutter to cut hairs that are trapped therebetween when in operation. Hence, cutting edges at the first wall may be formed at the metal component at the tooth stem portions thereof.

In one embodiment, the metal component comprises at least one anchoring element, particularly at least one positive-fit anchoring element extending from a respective tooth stem portion, wherein the plastic component and the metal component are connected at the at least one anchoring element. The at least one anchoring element may provide a locking geometry that may be engaged by or filled with the plastic material of the plastic component. Generally, the at least one anchoring element may longitudinally protrude from frontal ends of the tooth stem portions.

In one embodiment, the at least one anchoring element is inclined with respect to a top surface of the first wall, particularly rearwardly bended. In one embodiment, the at least one anchoring element is T-shaped, U-shaped or O-shaped, particularly when viewed from the top. In one embodiment, the at least one anchoring element is rearwardly offset from a top surface of the first wall. This may allow the plastic component to contact and cover a top side of the at least one anchoring element.

In one embodiment, the tips of the teeth are formed by the plastic component, wherein the plastic component further engages the positive-fit anchoring elements at a bonding area between the tooth stem portions of the metal component and the tips of the teeth. Consequently, the plastic component may be firmly bonded to the metal component and connected with the metal component in a form-fit or positive-fit manner at the same time.

In one embodiment, the plastic component and the metal component form an integrally formed part selected from the group consisting of insert-molded part, outsert-molded part and overmolded part. By way of example, the metal component may be provided as a metal insert component. The metal insert component may be arranged in a mold for the plastic component and at least sectionally overmolded with the plastic component.

In one embodiment, the teeth of the at least one toothed leading edge comprise, when viewed in a cross-sectional plane perpendicular to the lateral direction Y, a substantially U-shaped form comprising a first leg at the first wall and a second leg at the second wall, wherein the first leg and the second leg merge into one another at the tooth tips. Between the first leg and the second leg, a mounting gap or slot for the cutter may be provided, particularly for the teeth thereof.

According to a further aspect of the disclosure a blade set for a cutting appliance is presented. The blade set may comprise a stationary blade and a cutter formed according to at least some of the principles of the present disclosure. In some embodiments, the cutter comprises a guide opening, particularly a laterally extending slot, in which the intermediate wall of the stationary blade is arranged.

It is particularly preferred that the blade set consists of the stationary blade and the cutter. This may involve a driving force transmitting member for the cutter. In other words, it is preferred in some embodiments that the blade set comprises no further element. However, it is particularly preferred that the cutter is arranged in the guide slot without being biased by a separate biasing member, such as a biasing spring element. Consequently, it is preferred that a top side of the cutter is in contact with the first wall and that a bottom side of the cutter is in contact with the second wall. It goes without saying that the cutter may be arranged in the guide slot with a certain clearance with respect to the first wall and the second wall, respectively, since the cutter is preferably slidably arranged at the guide slot.

Relative motion may involve reciprocating motion of the cutter with respect to the stationary blade. In some embodiments, relative motion may involve rotation of the movable blade with respect to the cutter blade.

According to the above aspect, the guide opening of the cutter and the intermediate wall of the stationary blade may cooperate so as to define the longitudinal position of the cutter with respect to the stationary blade. Further, the intermediate wall of the stationary blade may retain the movable cutter at the stationary blade. Preferably, the intermediate wall at least partially extends through the guide opening. In other words, the intermediate wall may comprise a height extension (or: vertical extension) that fits in the guide opening of the cutter such that the cutter cannot be removed from the stationary blade without destroying or damaging at least one component of the assembly.

A respective assembly can be accomplished by inserting a paired arrangement of the cutter and the intermediate wall in the guide slot of the (intermediate) stationary blade and then attaching, particularly fixedly attaching, the intermediate wall to the stationary blade, particularly to the first wall thereof.

In one embodiment of the blade set, the guide opening is adapted to the intermediate wall such that the intermediate wall defines the longitudinal position of the cutter with respect to the stationary blade. In other words, the guide opening of the cutter may comprise a longitudinal extension (generally perpendicular to the lateral extension of the at least one toothed leading edge) that is adapted to a respective longitudinal extension of the intermediate wall. Since the cutter is basically adapted to be moved with respect to the stationary blade, a defined longitudinal clearance fit between the guide opening and the intermediate wall is preferred. The movement of the cutter may involve lateral movement. Generally, the cutter is configured for sliding movement with respect to the stationary blade.

The guide slot of the stationary blade may be jointly defined by the first wall, the second wall, and the intermediate wall. Hence, the guide slot of the stationary blade may position the cutter in the vertical direction (or: height direction) and in the longitudinal direction. Further, the stationary blade, particularly the intermediate wall may provide at least one lateral limit stop for the cutter, preferably two opposite lateral limit stops. The lateral limit stop may be defined by a respective lateral end face of the intermediate wall that cooperates with an inner lateral face of the guide slot of the cutter. It is worth mentioning in this context that the transmitting member may be relieved from respective guide and retaining functions.

In one embodiment of the blade set, the intermediate wall comprises a plurality of longitudinally protruding contact elements that are configured to contact laterally extending inner guide faces of the guide opening of the cutter. This may have the advantage that a resulting slide contact surface between the intermediate wall and the cutter can be reduced which may reduce frictional losses and, accordingly, power consumption and heat generation.

In one embodiment of the blade set, the intermediate wall of the a stationary blade comprises a guiding portion and a retaining portion, wherein the retaining portion at least partially protrudes beyond the guiding portion such that the cutter is retained at the stationary blade. Hence, the cutter may be undetachably retained but reciprocatingly movable with respect to the stationary blade in the lateral direction. It is preferred that the retaining portion at least partially protrudes beyond the guiding portion in the longitudinal direction. By way of example, the first wall and the intermediate wall may define a double-T shaped section (also referred to as I-beam section) which provides a receiving and guiding contour for the cutter.

In one embodiment of the blade set, the thickness of the guiding portion is adapted to the height of the cutter so as to enable a defined clearance fit of the cutter at the stationary blade. The thickness of the guiding portion may be slightly greater than the thickness of the cutter, at least in the vicinity of the guide opening. Hence, the cutter may be received in a tight but somewhat slidingly movable manner In one embodiment of the blade set, each of the guiding portion and the retaining portion is made from a respective sheet metal layer, and wherein the guiding portion and the retaining portion are fixedly interconnected. Consequently, the intermediate wall may comprise a layered structure. By way of example, the guiding portion and the retaining portion may be obtained through respective cutting processes from sheet metal blanks or coils. Cutting may generally involve blanking, particularly stamping and fine punching. Respective layers forming the the guiding portion and the retaining portion can be fixedly interconnected, particularly bonded, more particularly welded to each other.

In the alternative, the guiding portion and the retaining portion of the intermediate wall may be integrally formed. Hence, the guiding portion and the retaining portion may be manufactured as a single piece. By way of example, the guiding portion and the retaining portion may be obtained by machining a respective intermediate blank intermediate wall.

In some embodiments, the retaining portion may have an overall longitudinal extension that is at least slightly greater that the an overall longitudinal extension of the guiding portion and a respective overall longitudinal extension of the guide opening. Generally, the retaining portion may be shaped as a cover plate that at least partially protrudes beyond the guiding portion.

In one embodiment of the blade set, the tapered scraper profile of the at least one scraping portion engages the first wall of the stationary blade upon relative motion between the cutter and the stationary blade to scrape off accumulated dirt and debris when in operation. In some embodiments, the cutter comprises at least one scraping portion comprising a tapered scraper profile that, upon relative motion between the cutter and the stationary blade, at least partially engages the second wall of the stationary blade to scrape off accumulated dirt and debris.

According to still another aspect of the disclosure a method of manufacturing a blade set for a cutting appliance is presented, said method comprising the following steps:

- manufacturing a stationary blade formed according to at least some aspects of the present disclosure, the stationary blade comprising an intermediate wall;
- providing a cutter comprising at least one toothed leading edge arranged to cooperate with at least one respective toothed leading edge of the stationary blade, wherein the cutter further comprises a guide opening, particularly a laterally extending slot;
- positioning the intermediate wall in the guide opening of the cutter;
- jointly inserting the cutter and the intermediate wall into the guide slot of the stationary blade, particularly jointly feeding the movable cutting blade and the intermediate wall through a lateral opening of the stationary blade; and
- attaching the intermediate wall to the first wall, particularly bonding the intermediate wall to the first wall.

In one embodiment of the blade set manufacturing method, the stationary blade is configured such that the intermediate wall defines a central offset between the first wall and the second wall. Furthermore, the step of jointly inserting the cutter and the intermediate wall may be preceded by the step of providing a package comprising the intermediate wall and the cutter. It should therefore be understood that the step of manufacturing the stationary blade does not necessarily involve fixing or attaching the intermediate wall to the first wall. By contrast, manufacturing the stationary blade may actually result in providing a semi-finished stationary blade and an intermediate wall, whereas in another step, the (final) stationary blade may be formed by attaching the intermediate wall to the first wall. This may involve locking or securing the cutter at the stationary blade.

According to another aspect of the present disclosure, a method of manufacturing a cutter for a blade set of a cutting appliance is presented, the method comprising at least one of the following steps:

- providing sheet metal material;
- processing the sheet metal material to obtain a cutter comprising at least one toothed leading edge arranged to cooperate with at least one respective toothed leading edge of a stationary blade,
- processing the cutter to form at least one scraping portion comprising a tapered scraper profile at least partially extending in a longitudinal direction that is perpendicular to a cutting motion direction of the cutter, wherein the at least one scraping portion is, in a mounted state, arranged to contact a stationary blade of the blade set at a first wall thereof to scrape off accumulated dirt and debris when the cutter and the stationary blade are moved with respect to each other when in operation.

Preferably, the method further comprises forming a guide opening, particularly a laterally extending slot, at the cutter, and forming at least one scraping portion at a lateral end surface of the guide opening.

In a further refined embodiment of the cutter manufacturing method, at least one scraping portion is processed at a lateral end surface of the guide opening, wherein the scraping portion is arranged as an interrupted scraping portion, comprising at least two sections, and wherein an inwardly protruding abutment tab is arranged between the sections. This may facilitate an exemplary assembly process for the blade set, particularly a step when the cutter and the intermediate wall are jointly inserted into the guide slot of the stationary blade. Further, the at least one inwardly protruding abutment tab may prevent the tapered scraper profile from contacting the intermediate wall when the blade set is in operation.

Preferred embodiments of the invention are defined in the dependent claims. It shall be understood that the claimed method has similar and/or identical preferred embodiments as the claimed device and as defined in the dependent claims.

BRIEF DESCRIPTION OF THE DRAWINGS

Several aspects of the disclosure will be apparent from and elucidated with reference to the embodiments described hereinafter. In the following drawings

DETAILED DESCRIPTION OF THE EMBODIMENTS

Figure 1:
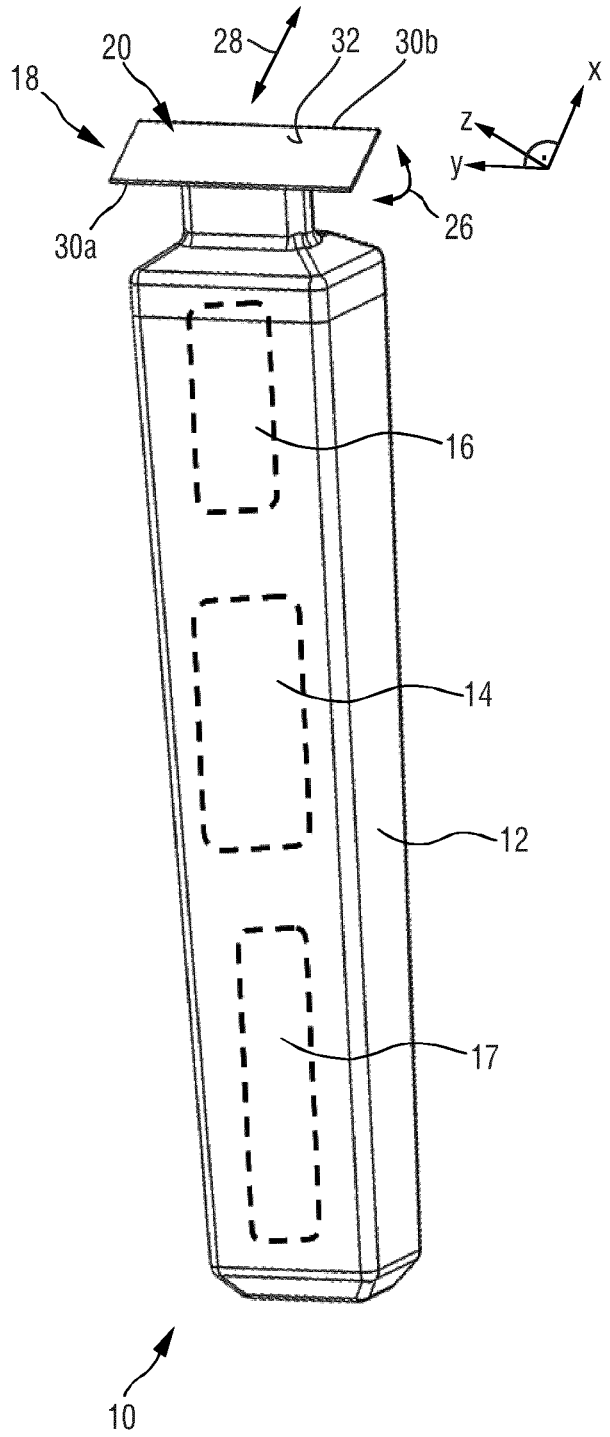
FIG. 1 shows a schematic perspective view of an exemplary electric cutting appliance fitted with an embodiment of a blade set.

FIG. 1 schematically illustrates, in a simplified perspective view, an exemplary embodiment of a cutting appliance 10, particularly an electric cutting appliance 10. The cutting appliance 10 may comprise a housing 12, a motor indicated by a dashed block 14 in the housing 12, and a drive mechanism or drivetrain indicated by a dashed block 16 in a housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 17.

The cutting appliance 10 may further comprise a cutting head 18. At the cutting head 18, a blade set 20 may be attached to the cutting appliance 10. The blade set 20 may be driven by the motor 14 via the drive mechanism or drivetrain 16 to enable a cutting motion. The cutting motion may generally be regarded as a relative motion between a stationary blade 22 and a movable blade 24 which are shown and illustrated in more detail in FIG. 3, for instance, and will be described and discussed hereinafter. Generally, a user may grasp, hold and manually guide the cutting appliance 10 through hair in a moving direction 28 to cut hair. The cutting appliance 10 may be generally regarded as a hand-guided and hand-operated electrically powered device. Furthermore, the cutting head 18 or, more particularly, the blade set 20 can be connected to the housing 12 of the cutting appliance 10 in a pivotable manner, refer to the curved double-arrow indicated by reference numeral 26 in FIG. 1. In some embodiments, the cutting appliance 10 or, more specifically, the cutting head 18 including the blade set 20 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 18 comprising the blade set 20 is passed along a path at a desired distance relative to the skin.

When being guided moved through hair, the cutting appliance 10 including the blade set 20 is typically moved along a common moving direction which is indicated by the reference numeral 28 in FIG. 1. It is worth mentioning in this connection that, given that the cutting appliance 10 is typically manually guided and moved, the moving direction 28 thus not necessarily has to be construed as a precise geometric reference having a fixed definition and relation with respect to the orientation of the cutting appliance 10 and its cutting head 18 fitted with the blade set 20. That is, an overall orientation of the cutting appliance 10 with respect of the to-be-cut hair at the skin may be construed as somewhat unsteady. However, for illustrative purposes, it may be fairly assumed that the (imaginary) moving direction 28 is parallel (or generally parallel) to a main central plane of a coordinate system which may serve in the following as a means for describing structural features of the cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiments of the cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations. It is further worth mentioning that, for the purpose of the present disclosure, the coordinate system X-Y-Z is generally aligned with main directions and orientations of the cutting head 18 including the blade set 20.

Figure 2:
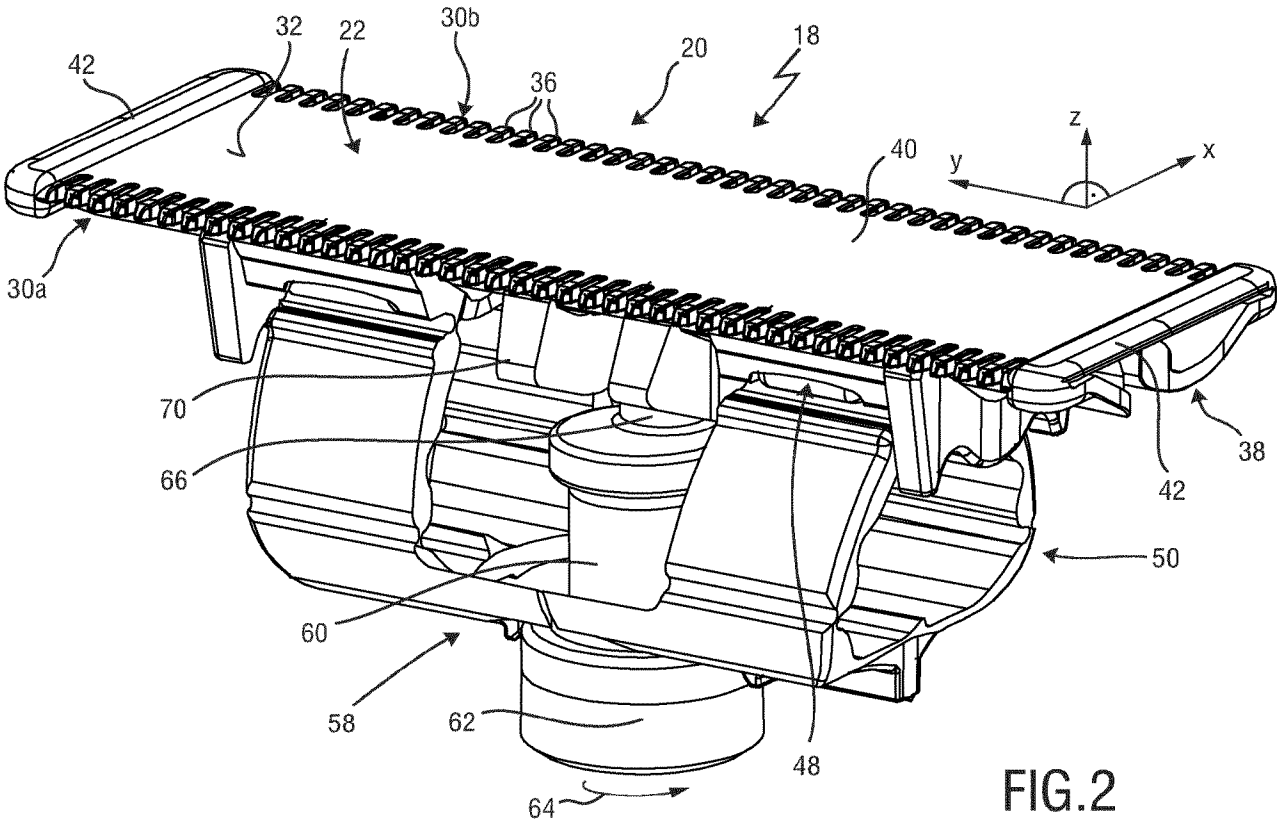
FIG. 2 shows a schematic perspective top view of a cutting head comprising a blade set.

FIG. 2 illustrates a perspective top view of an embodiment of the cutting head 18 that may be attached to the cutting appliance as shown in FIG. 1. The cutting head 18 is provided with the blade set 20 as already indicated above. The blade set 20 comprises a stationary blade 22 and a cutter 24 (hidden in FIG. 2). The cutter 24 may be generally referred to as movable cutter blade 24. Further reference is made in this connection to the exploded view of the blade set 20 shown in FIG. 3 and FIG. 4. The stationary blade 22 and the cutter 24 are configured to be moved with respect to each other, thereby cutting hairs at their respective cutting edges.

The stationary blade 22 further comprises a top surface 32 which may be regarded as a skin-facing surface. Typically, when in operation as a shaving device, the cutting appliance 10 is oriented in such a way that the top surface 32 is basically parallel to or slightly inclined with respect to the skin. However, also alternative operation modes may be envisaged, where the top surface 32 is not necessarily parallel or, at least, substantially parallel to the skin. For instance, the cutting appliance 10 may be further used for beard styling or, more generally, hair styling. Hair styling may aim at the processing of considerably sharp edges or transitions between differently treated hair portions or beard portions of the user. By way of example, hair styling may involve precise shaping of sideburns or further distinct patches of facial hair. Consequently, when used in a styling mode, the top surface 32 and the currently to-be-treated skin portion are arranged at an angle, particularly substantially perpendicular to each other.

However, primarily for illustrative purposes, the top surface 32 and similarly oriented portions and components of the cutting appliance 10 may be regarded as skin-facing components and portions hereinafter. Consequently, elements and portions that are oriented in an opposite manner may be regarded as rearwardly oriented elements and portions or rather as elements and portions facing away from the skin hereinafter, for the purpose of disclosure.

As shown in FIG. 2, the stationary blade 22 may define a first leading edge 30*a* and a second leading edge 30*b* that are offset from each other in the longitudinal direction X. The at least one toothed leading edge 30*a*, 30*b* may generally extend in the lateral direction Y. The top surface 32 may be regarded as a surface that is generally parallel to a plane defined by the longitudinal direction X and the lateral direction Y. At the at least one toothed leading edge 30, a plurality of teeth 36 of the stationary blade 22 may be provided. The teeth 36 may alternate with respective teeth slots. The teeth slots may define gaps between the teeth 36. Hairs may enter the gaps when the cutting appliance 10 is moved through hair in the moving direction 28 (FIG. 1).

The stationary blade 22 may be arranged as a metal-plastic composite component, for instance. In other words, the stationary blade 22 may be obtained from a multi-step manufacturing method that may include providing a metal component 40 (see also FIG. 3 and FIG. 4) and forming or, more precisely, molding a plastic component 38 including bonding the metal component 40 and the plastic component 38. This may particularly involve forming the stationary blade 22 by an insert-molding process, outsert-molding process or by an overmolding process. Generally, the stationary blade 22 may be regarded as a two-component stationary blade 22. However, since the stationary blade 22 is preferably formed by an integrated manufacturing process, basically no conventional assembly steps are required when forming the stationary blade 22. Rather, the integrated manufacturing process may include a net-shape manufacturing step or, at least, a near-net-shape manufacturing process.

Forming the stationary blade 22 from of different components, particularly integrally forming the stationary blade 22 may further have the advantage that portions thereof that have to endure high loads during operation may be formed from respective high-strength materials (e.g. metal materials) while portions thereof that are generally not exposed to huge loads when in operation may be formed from different materials which may significantly reduce manufacturing costs. Forming the stationary blade 22 as a plastic-metal composite part may further have the advantage that skin contact may be experienced by the user as being more comfortable. Particularly the plastic component 38 may exhibit a greatly reduced thermal conductivity when compared with the metal component 40. Consequently, heat emission sensed by the user when cutting hair may be reduced. In conventional cutting appliances, heat generation may be regarded as a huge barrier for improving the cutting performance. Heat generation basically limits the power and/or cutting speed of cutting appliances. By adding basically heat insulating materials (e.g. plastic materials) heat transfer from heat-generating spots (e.g. cutting edges) to the user's skin may be greatly reduced. This applies in particular at the tips of the teeth 36 of the stationary blade 22 which may be formed of plastic material.

Figure 10:
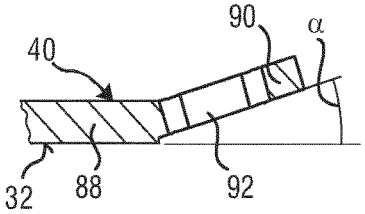
FIG. 10 is an enlarged detailed view of the metal component of the stationary blade basically corresponding to the view of FIG. 9.

By way of example, the plastic component 38 of the stationary blade 22 may be fitted with lateral protecting elements 42 which may also be referred to as so-called lateral side protectors. The lateral protecting elements 42 may cover lateral ends of the stationary blade 22, refer also to FIGS. 3, 4 and 10. Consequently, direct skin contact at the relatively sharp lateral ends of the metal component 40 can be prevented. The at least one lateral protecting element 42 may be formed as an integrated part of the plastic component 38.

The stationary blade 22 may be further provided with mounting elements 48. The mounting elements 48 may be arranged at the plastic component 38, particularly integrally formed with the plastic component 38, refer also to FIGS. 3, 4 and 10. The mounting elements 48 may comprise mounting protrusions, particularly snap-on mounting elements. The mounting elements 48 may be configured to cooperate with respective mounting elements at the linkage mechanism 50. It is particularly preferred that the blade set 20 can be attached to the linkage mechanism 50 without any further separate attachment member.

The linkage mechanism 50 (refer to FIG. 2) may connect the blade set 20 and the housing 12 of the cutting appliance 10. The linkage mechanism 50 may be configured such that the blade set 20 may swivel or pivot during operation when being guided through hair. The linkage mechanism 50 may provide the blade set 20 with a contour following capability.

FIG. 2 further illustrates an eccentric coupling mechanism 58. The eccentric coupling mechanism 58 may be regarded as a part of the drive mechanism or drivetrain 16 of the cutting appliance 10. The eccentric coupling mechanism 58 may be arranged to transform a rotational driving motion, refer to a curved arrow indicated by reference numeral 64 in FIG. 2, into a reciprocating motion of the movable blade 24 with respect to the stationary blade 22, refer also to FIG. 14 in this connection (double-arrow denoted by reference numeral 126). The eccentric coupling mechanism 58 may comprise a driveshaft 60 that is configured to be driven for rotation about an axis 62. At a front end of the driveshaft 60 facing the blade set 22 an eccentric portion 66 may be provided. The eccentric portion 66 may comprise a cylindrical portion which is offset from the (central) axis 62. Upon rotation of the driveshaft 60, the eccentric portion 66 may revolve around the axis 62. The eccentric portion 66 is arranged to engage a transmitting member 70 which may be attached to the movable blade 24.

Figure 3:
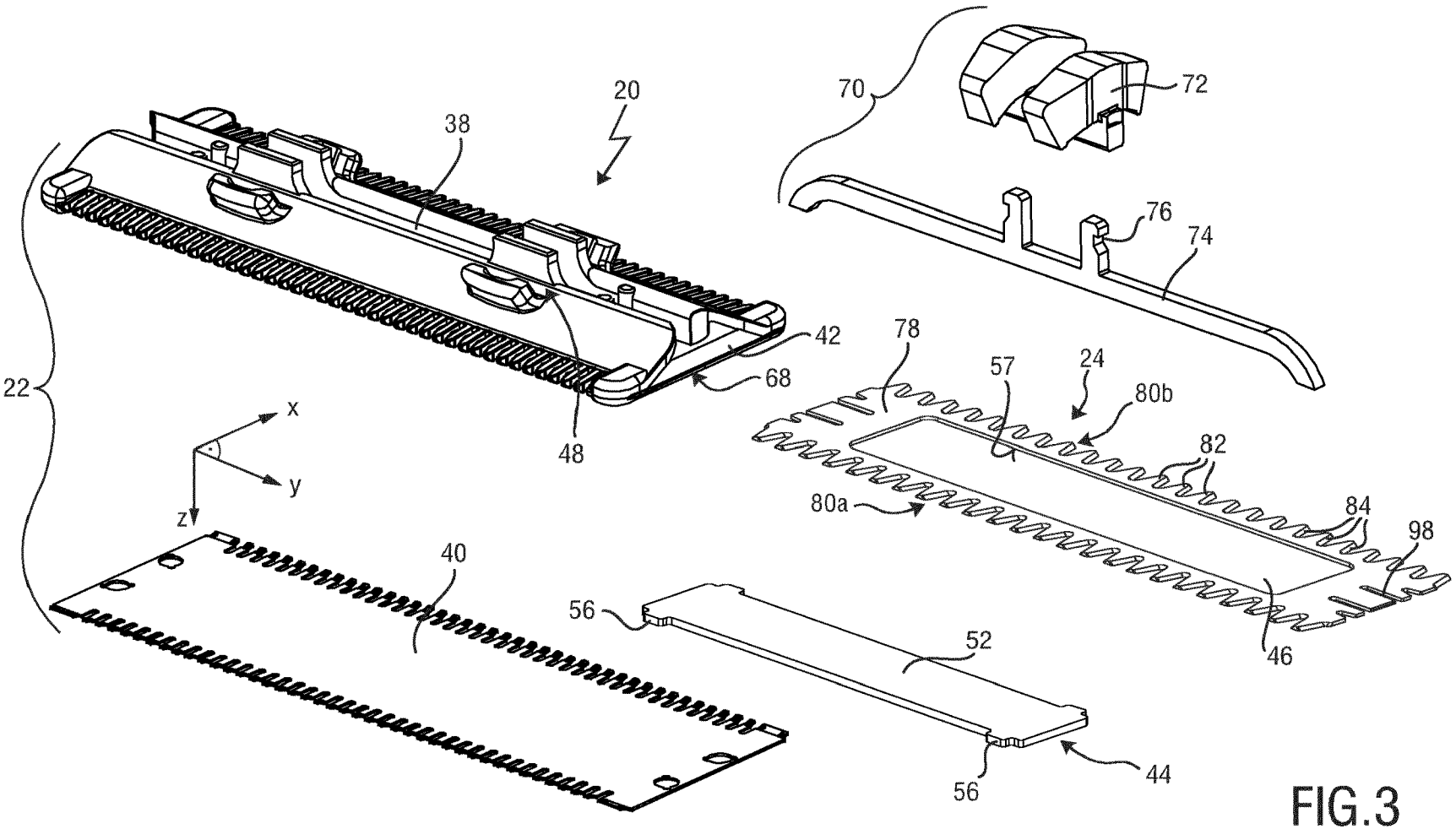
FIG. 3 is an exploded perspective bottom view of an embodiment of a blade set that is similar to the blade set shown in FIG. 2.
Figure 4:
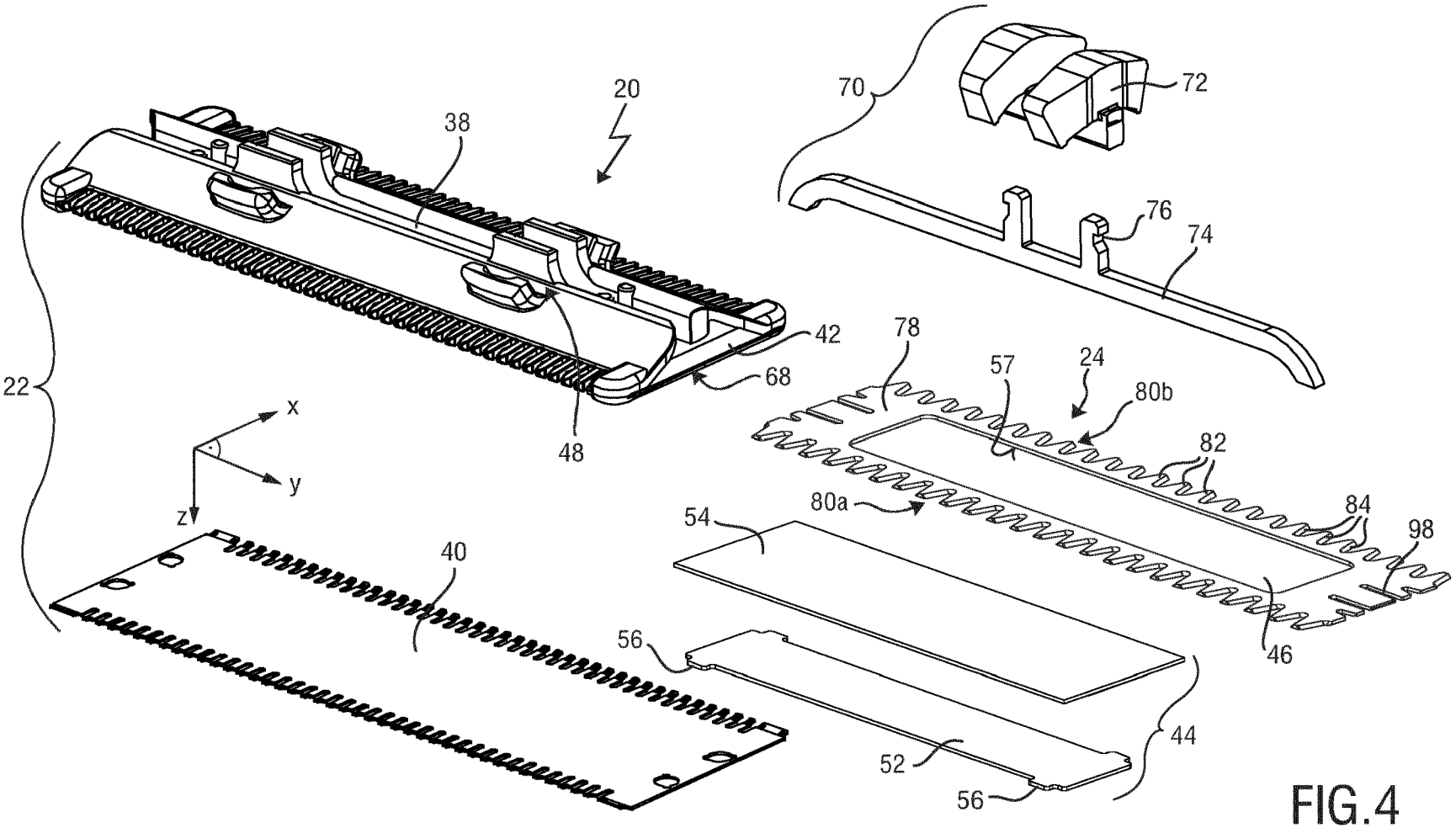
FIG. 4 is an exploded perspective bottom view of a further embodiment of a blade set that is similar to the blade set shown in FIG. 2.

With further reference to the embodiments shown in exploded view in FIG. 3 and FIG. 4, the transmitting member 70 will be further detailed and described. The transmitting member 70 may comprise a reciprocating element 72 which may be configured to be engaged by the eccentric portion 66 of the driveshaft 60, refer also to FIG. 2. Consequently, the reciprocating element 72 may be reciprocatingly driven by the driveshaft 60. The transmitting member 70 may further comprise a connector bridge 74 which may be configured to contact the cutter 24, particularly a main portion 78 thereof. By way of example, the connector bridge 74 may be bonded to the cutter 24. Bonding may involve soldering, welding and similar processes. The reciprocating element 72 may be bonded to the connector bridge 74. To this end, insert molding, outsert molding and/or overmolding processes may be utilized. It might be even further preferred in this context that the cutter 24 comprises at least one lateral end slot 98, preferably two pairs of lateral end slots 98 at opposite lateral ends of the cutter 24. The at least one lateral end slot 98 may be arranged as a basically laterally extending slot or notch. The at least one lateral end slot 98 may be provided to compensate for distortion, particularly heat induced welding distortion, that may result from the attachment of the connector bridge 74 to the cutter 24. To this end, the at least one lateral end slot 98 may be arranged in the vicinity of a respective bonding spot or welding sport. Preferably, a pair of lateral end slots 98 is arranged adjacent to a respective bonding spot or welding sport wherein the spot is arranged between the lateral end slots 98.

However, at least in some embodiments, the connector bridge 74 or a similar connecting element of the transmitting member 70 may be rather attached to the cutter 24. As used herein, attaching may involve plugging in, pushing in, pressing in or similar mounting operations. The transmitting member 70 may further comprise a mounting element 76 which may be arranged at the connector bridge 74. At the mounting element 76, the reciprocating element 72 may be attached to the connector bridge 74. By way of example, the connector bridge 74 and the mounting element 76 may be arranged as a metal part. By way of example, the reciprocating element 72 may be arranged as a plastic part. For instance, the mounting element 76 may involve snap-on elements for fixing the reciprocating element 72 at the connector bridge 74. However, in the alternative, the mounting element 76 may be regarded as an anchoring element for the reciprocating element 72 when the latter one is firmly bonded to the connector bridge 74.

It is worth mentioning in this regard that the transmitting member 70 may be primarily arranged to transmit a lateral reciprocating driving motion to the cutter 24. However, the transmitting member 70 may be further arranged to serve as a loss prevention device for the cutter 24 at the blade set 20.

Figure 15:
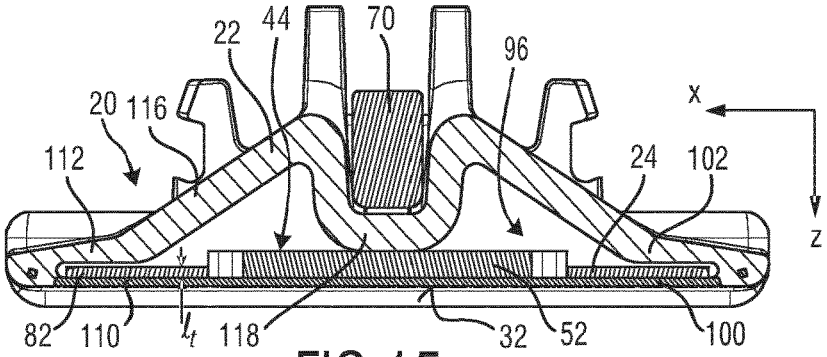
FIG. 15 is a cross-sectional side view of a blade set as shown in FIG. 14 taken along the line XV-XV in FIG. 14.
Figure 16:
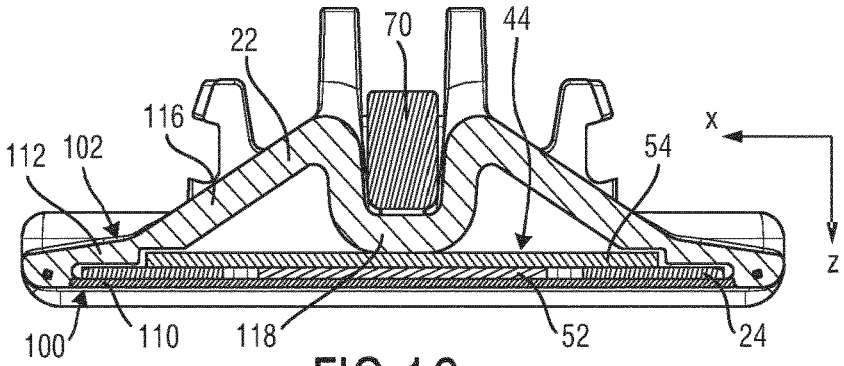
FIG. 16 is a further cross-sectional side view of another embodiment of a blade set as shown in FIG. 14 taken along the line XVI-XVI in FIG. 14.

FIG. 3 further illustrates an embodiment of the blade set 20 that implements an intermediate wall 44. FIG. 4 further illustrates an embodiment of the blade set 20 that implements an alternative embodiment of the intermediate wall 44. In the assembled state, the intermediate wall 44 may be fixedly attached of the blade set 20 to the stationary blade 22, particularly to a first wall 100 thereof, refer also to FIG. 7 and to FIG. 8. More precisely, the intermediate wall 44 may be fixedly attached in the assembled state to the metal component 40. A cross-sectional view through an embodiment that is similar to the embodiment of the blade set 20 as shown in FIG. 3 is illustrated in FIG. 15. A cross-sectional view through an embodiment that is similar to the embodiment of the blade set 20 as shown in FIG. 4 is illustrated in FIG. 16.

Figure 7:
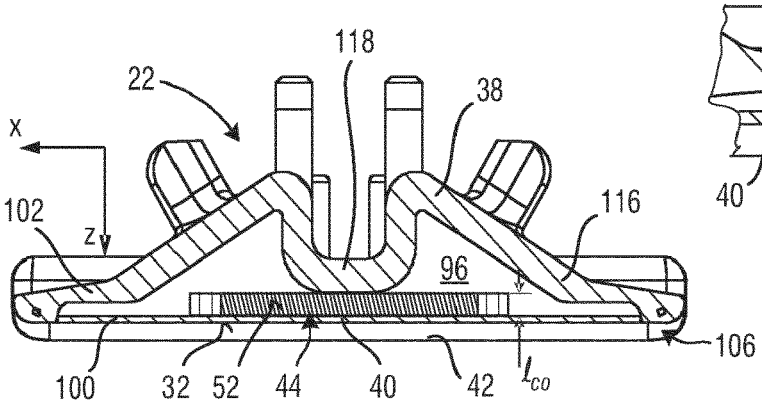
FIG. 7 is a cross-sectional view of the stationary blade shown in FIG. 5 taken along the line VII-VII in FIG. 5.

As can be seen from FIGS. 3, 7 and 15, the intermediate wall 44 may comprise a guide portion 52, and may be further configured to cooperate with a respective guide opening 46 at the cutter 24. To this end, the intermediate wall 44 may comprise contact elements 56 that are preferably arranged at the guide portion 52. By way of example, two pair of opposite contact elements 56 may be provided at opposite lateral ends of the guide portion 52. The contact elements 56 are configured to contact at least one inner guide face 57 provided at the guide opening 46. The contact elements 56 may be referred to as contact tabs. The at least one inner guide face 57 may be referred to as laterally extending guide surface. Generally, the intermediate wall 44 may be configured to define a longitudinal position of the cutter 24 at the stationary blade 22.

Figure 11:
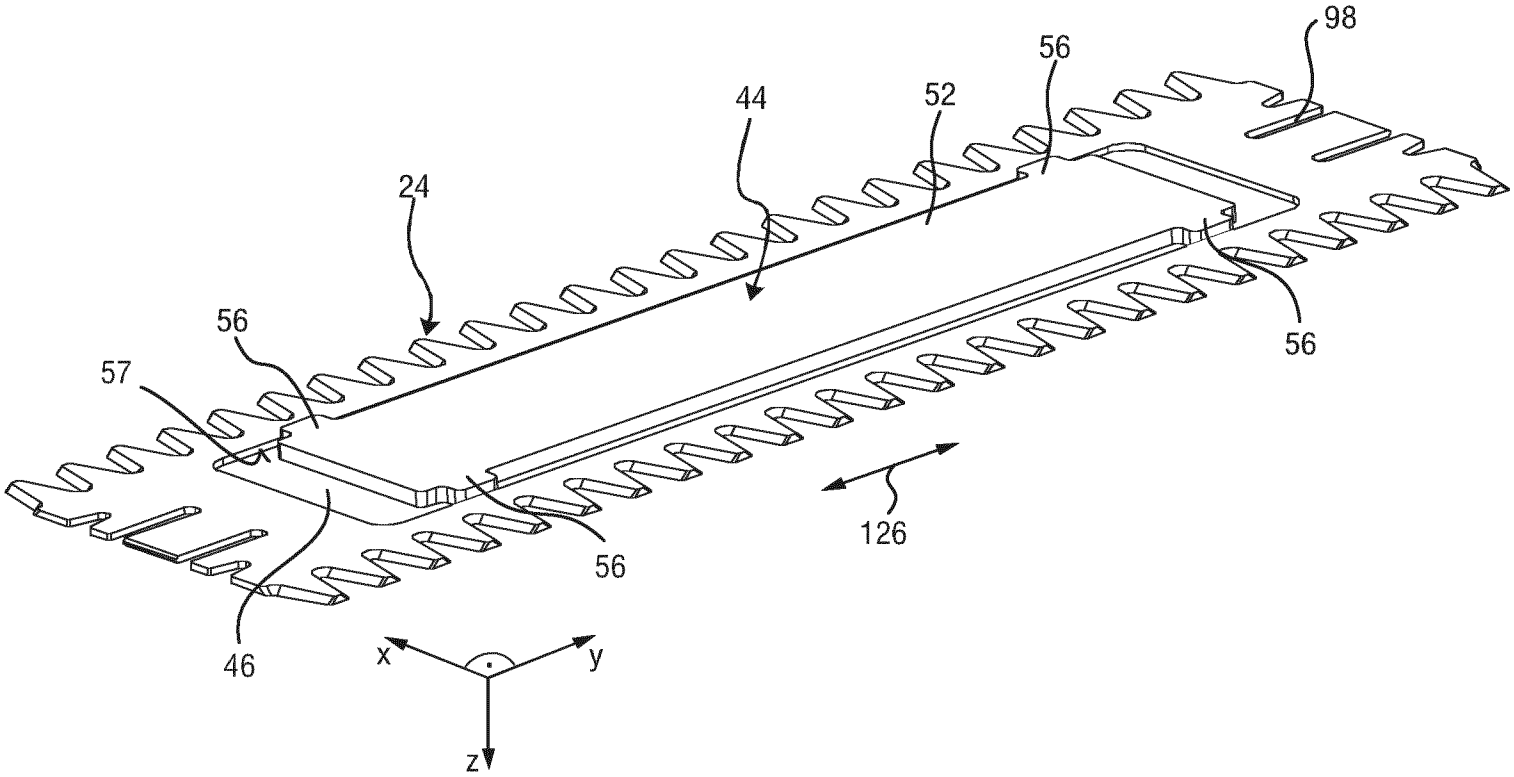
FIG. 11 is a perspective bottom view of an arrangement of a cutter comprising a guide opening, and an intermediate wall.

Further reference in this regard is made to FIG. 11. FIG. 11 shows an arrangement wherein the cutter 24 and the intermediate wall 44 are mated or paired. It can be further seen that the cutter 24 is at least slightly laterally movable with respect to the intermediate wall 44, refer to a double-arrow indicated by reference numeral 126. With respect to the longitudinal direction (X-direction), tight clearance fit between the intermediate wall 44 and the cutter 24 may be desired.

With further reference to FIGS. 3, 7 and 15, the cooperation of the intermediate wall 44 with the plastic component 38 and the metal component will be further detailed and explained. Generally, the plastic component 38 may form at least a substantial portion the second wall 102. Generally, the metal component 40 may form at least a substantial portion the first wall 100. Hence, the intermediate wall 44 may basically extend from first wall 100 to the second wall 102, particularly from the metal component 40 to the plastic component 38. As indicated above, it may be preferred that the intermediate wall 44 is fixedly attached to the first wall 100 and in abutment with the second wall 102 in the mounted state. It is not necessary required that the intermediate wall 44 is bonded to the second wall 102. It is however preferable that the intermediate wall 44 is arranged between the first wall 100 and the second wall 102 in the mounted state in an at least slightly biased manner.

Figure 8:
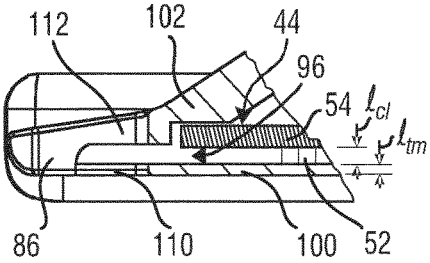
FIG. 8 is a partial cross-sectional side view of another embodiment of a stationary blade that is similar to the stationary blade shown in FIG. 5, wherein a location of the section is indicated by the line VIII-VIII in FIG. 5.

As can be seen from FIGS. 4, 8 and 16, in an alternative configuration, the stationary blade 20 may comprise an intermediate wall 44 that comprises a guide portion 52 and a retaining portion 54. The retaining portion 54 may at least slightly protrude above the guide portion 52 in the longitudinal direction (X-direction). As a consequence, the intermediate wall 44 may further define the vertical position (Z-position) of the cutter 24, refer particularly to FIG. 16.

Generally, the intermediate wall 44 and the metal component 40 may cooperate to secure the cutter 24 at the stationary blade 22 in an undetachable manner. This may be accomplished by the embodiment as shown in FIG. 3 and by the embodiment as shown in FIG. 4.

FIGS. 3 and 4 further illustrate the plastic component 38 and the metal component 40 of the stationary blade 22 in an exploded state. It is worth mentioning in this connection that, since it is preferred that the stationary blade 22 is integrally formed, the plastic component 38 thereof typically does not exist as such in an isolated unique state. Rather, at least in some embodiments, forming the plastic component 38 may necessarily involve firmly bonding the plastic component 38 to the metal component 40. The intermediate wall 44 may be attached thereto at a later stage.

The stationary blade 22 may comprise at least one lateral opening 68 through which the cutter 24 may be inserted. Consequently, the cutter may be inserted in the lateral direction Y. However, at least in some embodiments, the transmitting member 70 may be moved to the cutter 24 basically along the vertical direction Z. Mating the cutter 24 and the transmitting member 70 may therefore involve firstly inserting the cutter 24 through the lateral opening 68 of the stationary blade 22 and secondly, when the cutter 24 is arranged in the stationary blade 22, feeding or moving the transmitting member along the vertical direction Z to the stationary blade 22 so as to be connected to the cutter 24.

Generally, the cutter 24 may comprise at least one toothed leading edge 80 adjacent to the main portion 78. Particularly, the cutter 24 may comprise a first leading edge 80*a* and a second leading edge 80*b* that is longitudinally offset from the first leading edge 80*a*. At the at least one leading edge 80, a plurality of teeth 82 may be formed that are alternating with respective tooth slots. Each of the teeth 82 may be provided with respective cutting edges 84, particularly at their lateral flanks. The at least one toothed leading edge 80 of the cutter 24 may be arranged to cooperate with a respective toothed leading edge 30 of the stationary blade 22 when relative motion of the cutter 24 and the stationary blade 22 is induced. Consequently, the teeth 36 of the stationary blade 22 and the teeth 82 of the cutter 24 may cooperate to cut hair.

Figure 5:
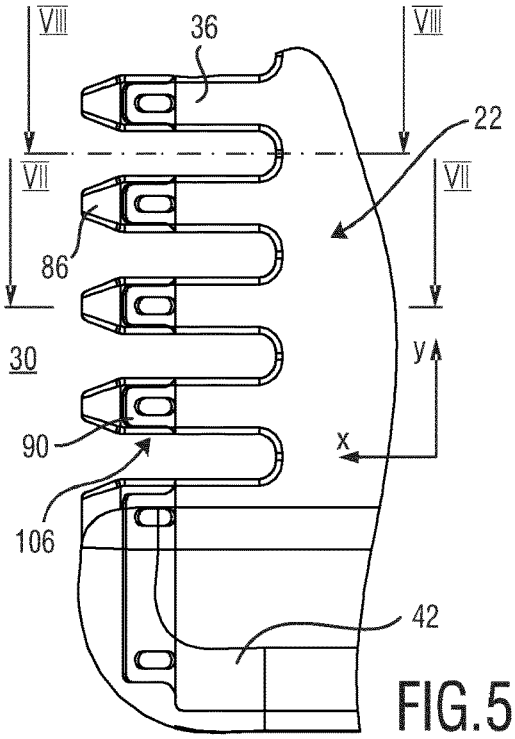
FIG. 5 is a partial top view of a stationary blade of the blade set shown in FIG. 2, wherein hidden edges of the stationary blade are shown for illustrated purposes.

With particular reference to FIGS. 5 to 10, the structure and configuration of an embodiment of the stationary blade 22 will be further detailed and illustrated. FIG. 5 is a partial top view of the stationary blade 22, wherein hidden portions of the metal component 40 (refer also to FIG. 6) are shown for illustrative purposes. At the teeth 36 of the stationary blade 22 tips 86 may be formed. The tips 86 may be primarily formed by the plastic component 38. However, substantial portions of the teeth 36 may be formed by the metal component 40. As can be best seen from FIG. 6, the metal component 40 may comprise so-called tooth stem portions 88 that may form a substantial portion of the teeth 36. The tooth stem portions 88 may be provided with respective cutting edges 94 that are configured to cooperate with cutting edges 84 of the teeth 82 of the cutter 24. At longitudinal ends of the tooth stem portions 88, anchoring elements 90 may be arranged. The anchoring elements 90 may be regarded as positive fit contact elements which may further strengthen the connection of the metal component 40 and the plastic component 38.

Figure 6:
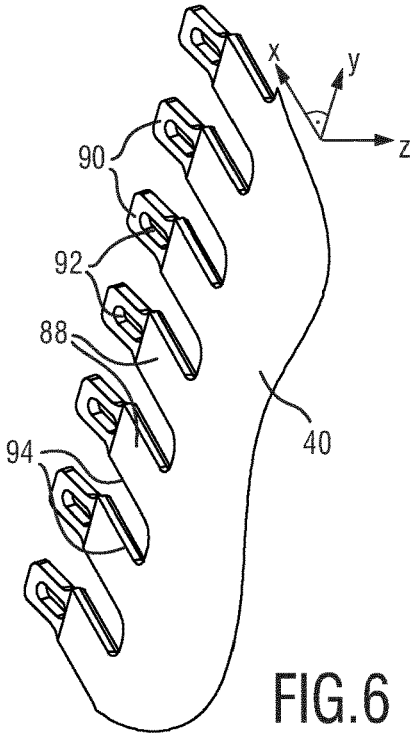
FIG. 6 is a partial perspective bottom view of a metal component of the stationary blade shown in FIGS. 3 and 4.

By way of example, the anchoring elements 90 may be provided with undercuts or recess portions. Consequently, the anchoring elements 90 may be arranged as barbed anchoring elements. Preferably, a respective portion of the plastic component 38 that contacts the anchoring elements 90 may not be detached or released from the metal component 40 without being damaged or even destroyed. In other words, the plastic component 38 may be inextricably linked with the metal component 40. As shown in FIG. 6, the anchoring elements 90 may be provided with recesses or holes 92. The holes 92 may be arranged as slot holes, for instance. When molding the plastic component 38, plastic material may enter the holes 92. As can be best seen from FIGS. 7 and 9, the plastic material may fill the recesses or holes 92 of the anchoring elements 90 from both (vertical)

sides, i.e. from the top side and the bottom side. Consequently, the anchoring elements 90 may be entirely covered by the plastic component 38. Adjacent to the anchoring elements 90, the tips 86 may be formed. Forming the tips 86 from the plastic component 38 may further have the advantage that the frontal end of the leading edge 30 is formed from a relatively soft material which may be further rounded or chamfered so as to soften edges. Consequently, contacting the user's skin with the frontal ends of the leading edge 30 is typically not experienced as causing skin irritation or similar adverse effects. Also high-temperature spots may be prevented at the tips 36 since the plastic component 38 is typically provided with a relatively low thermal conductivity coefficient, compared with the metal component 40.

Figure 9:
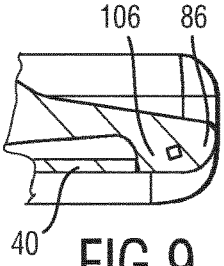
FIG. 9 is an enlarged detailed view of the stationary blade shown in FIG. 7 at a leading edge portion thereof.

As can be best seen from the cross-sectional views of FIGS. 7, 8 and 9, the edges of the tips 86 of the teeth 36 at the frontal ends of the leading edges 30 may be significantly rounded. As can be further seen, the transition between the metal component 40 and the plastic component 38 at the top surface 32 in the region of the teeth 36 may be substantially seamless or step-less. Further reference in this regard is made to FIG. 10. It may be advantageous to shape the anchoring elements 90 such that their top side (skin-facing side) is offset from the top surface 32. Consequently, also the skin-facing side of the anchoring elements 90 may be covered by the plastic component, refer also to FIG. 9. In one embodiment, the anchoring elements 90 may be inclined with respect to the top surface 32. The anchoring elements 90 may be arranged at an angle α (alpha) with respect to the tooth stem portions 88. It may be further preferred that the anchoring elements 90 are rearwardly bended with respect to the top surface 32. At least in some embodiments, the anchoring elements 90 may be thinner than the tooth stem portions 88. This may further enlarge the space which may be filled by the plastic component 38 when molding.

With further reference to FIG. 7, the stationary blade 22 will be further detailed and described. The stationary blade 22 may define and encompass a guide slot 96 for the cutter 24. To this end, the stationary blade 22 may comprise a first wall 100 and a second wall 102. For the purpose of this disclosure, the first wall 100 may be regarded as a skin-facing wall. This applies in particular when the blade set 20 is used for shaving. Consequently, the second wall 102 may be regarded as the wall facing away from the skin. In other words, the first wall 100 may be also referred to as top wall. The second wall 102 may also be referred to as bottom wall.

Mainly for illustrative purposes, the FIG. 7 and FIG. 8 illustrate slightly deviating embodiments of the intermediate wall 44, refer also to FIG. 3 and to FIG. 4. According to FIG. 7, the intermediate wall 44 primarily consists of a guide portion 52 that is adapted to a respective guide opening 46 of the cutter 24. According to FIG. 8, the intermediate wall 44 comprises guide portion 52 that is adapted to a respective guide opening 46 of the cutter 24 and a retaining portion 54. As can be seen from FIG. 7, the intermediate wall 44 may set a central offset $l_{co}$ between the first wall 100 and the second wall 102 of the stationary blade 22. This may be advantageous since—as a consequence—a desired gap between the first wall 100 and the second wall 102 at the teeth 36 may be accurately defined in this way.

Hence, the cutter 24 may be received in the guide slot 96 in an accurate and precise manner. As can be seen from FIG. 15, the cutter 24 comprises a height extension $l_t$. The respective desired gap may be determined by the central offset $l_{co}$. Consequently, the desired fit of the cutter 24 at the stationary blade 22 may be ensured even though the second wall 102 or, more precisely, the plastic component 38 as such typically cannot be manufactured with absolutely tight tolerances. Furthermore, shrinkage effects and warpage may be may be compensated for to at least some extent by precisely setting the central offset $l_{co}$.

As can be seen from FIG. 8, the intermediate wall 44 may further define a resulting gap $l_{cl}$ for the a to-be-mounted cutter 24. This may be achieved when the guide portion 52 is sufficiently adapted to (e.g. slightly larger than) the height $l_t$ of the cutter 24 and when the intermediate wall 44 is further provided with a retaining portion 54 that at least partially protrudes beyond the guide portion 52. As a consequence, the second wall 102 and/or the plastic component 38 may be to some extent relieved from defining the desired gap or clearance for the cutter 24.

The first wall 100 and the second wall 102 may jointly define the teeth 36 of the stationary blade 22. The teeth 36 may comprise a slot or gap for the cutter 24, particularly for the teeth 82 thereof arranged at the at least one toothed leading edge 80. As indicated above, at least a substantial portion of the first wall 100 may be formed by the metal component 40. At least a substantial portion of the second wall 102 may be formed by the plastic component 38. At the embodiment illustrated in FIG. 7, the second wall 102 is entirely formed by the plastic component 38. Rather, the first wall 100 is jointly formed by the plastic component 38 and the metal component 40. This applies in particular at the leading edge 30. The first wall 100 may comprise, at the respective tooth portions thereof, bonding portions 106, where the plastic component 38 is bonded to the metal component 40. The bonding portions 106 may involve the anchoring elements 90 of the metal component 40 and the plastic material of the plastic component 38 covering the anchoring elements 90.

FIG. 7 and FIG. 9 illustrate a cross-section through a tooth 36, refer also to the line VIII-VIII in FIG. 5. By contrast, FIG. 8 illustrates a cross-section through a tooth slot, refer to line VII-VII in FIG. 5. As can be seen from FIG. 7 and FIG. 8, the first wall 100 and the second wall 102 may jointly form the leading edge 30 including the teeth 36. The first wall 100 and the second wall 102 may jointly define a basically U-shaped lateral cross-section of the respective teeth 36. The first wall 100 may define a first leg 110 of the U-shaped form. The second wall 102 may define a second leg of the U-shaped form. The first leg 110 and the second leg 112 may be connected at the tips 86 of the teeth 36. Between the first leg 110 and the second leg 112 a slot or gap for the cutter 24 may be provided.

As can be further seen from FIG. 7, the first wall 100 may be significantly thinner than the second wall 102 of the stationary blade 22. Consequently, at the skin-facing first wall 100, hair can be cut very close to the skin. It is therefore desirable to reduce the thickness of the first wall 100, particularly of the metal component 40. By way of example, the thickness $l_{tm}$ (refer to FIG. 8) of the metal component 40, particularly at the tooth stem portions 88, may be in the range of about 0.08 mm to 0.15 mm. Consequently, the first wall 100 as such may exhibit a considerably small strength and rigidity. It is therefore beneficial to back up or strengthen the first wall 100 by adding the second wall 102. Since the thickness of the second wall 102 basically does not influence the smallest achievable cutting length (e.g. the length of remaining hairs at the skin), the thickness of the second wall 102, particularly at the respective leading edges 30, may be significantly greater than the thickness $l_{tm}$ of the first wall 100, particularly of the metal component 40. This may provide the stationary blade 22 with sufficient strength and stability. As can be further seen from FIG. 7, the first wall 100 and the second wall 102 may basically form a closed profile, at least sectionally along their lateral extension, refer also to FIG. 12 and FIG. 13 in this connection. This may particularly apply when the stationary blade 22 is provided with a first and a second leading edge 30*a*, 30*b*. Consequently, the stiffness of the stationary blade 22, particularly the stiffness against bending stress or torsional stress may be further increased.

In one embodiment, the second wall 102 may comprise, adjacent to the second leg 112 at the respective leading edge 30, an inclined portion 116. Assuming that the stationary blade 22 is basically symmetrically shaped with respect to a central plane defined by the vertical direction Z and the lateral direction Y, the second wall 102 may further comprise a central portion 118 adjacent to the inclined portion 116. Consequently, the central portion 118 may be interposed between a first inclined portion 116 and a second inclined portion 116. The first inclined portion 116 may be positioned adjacent to a respective second leg 112 at a first leading edge 30*a*. The second inclined portion 116 may be positioned adjacent to a respective second leg at the second leading edge 30*b*. As can be best seen in FIG. 7, the second wall 102 may therefore comprise a basically M-shaped cross-section primarily defined by the inclined portions 116 and the central portion 118.

Figure 12:
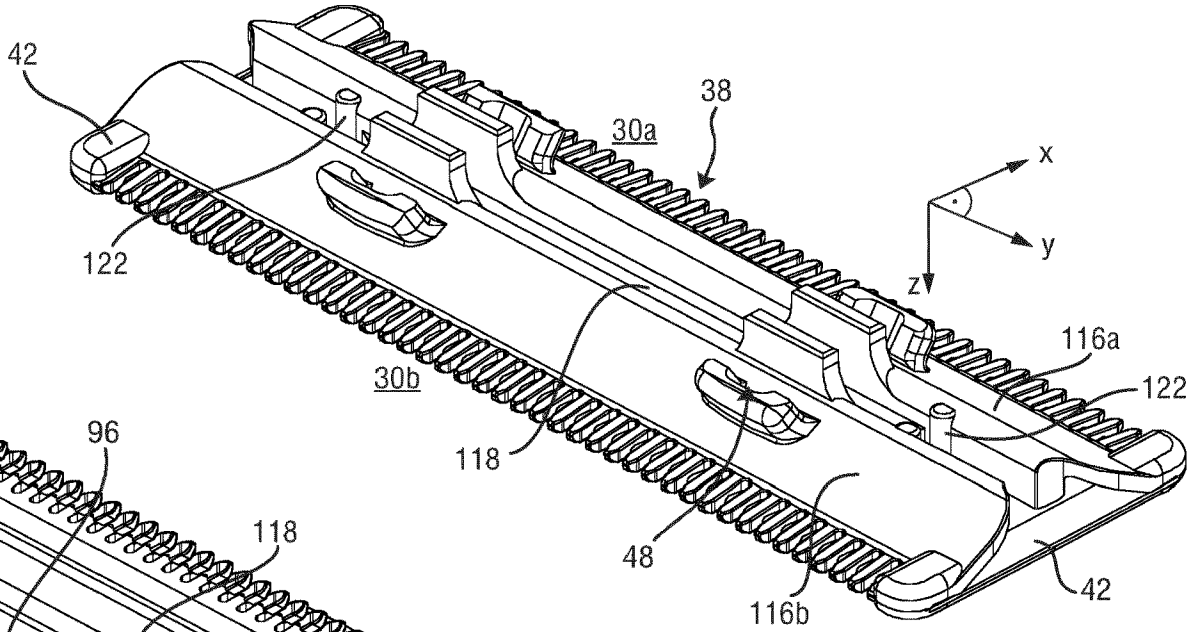
FIG. 12 is a perspective bottom view of a plastic component of a stationary blade as shown in FIG. 2 to FIG. 4.
Figure 13:
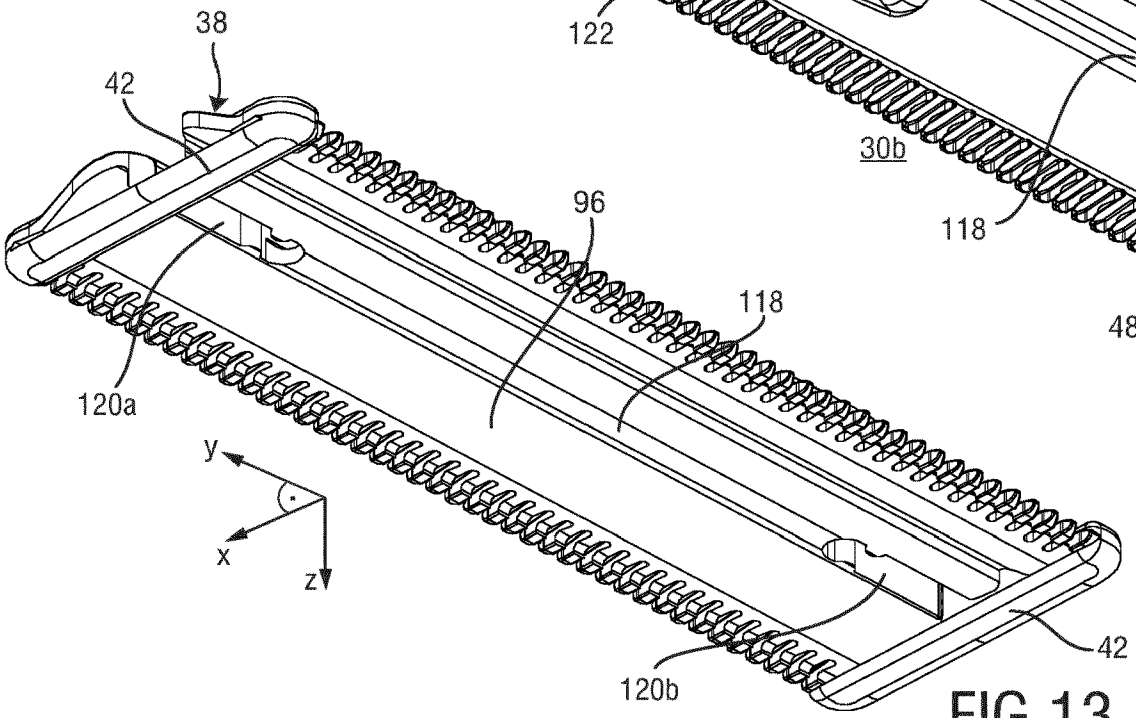
FIG. 13 is a perspective top view of the plastic component shown in FIG. 12.

With further reference to FIG. 12 and FIG. 13, the shape and configuration of an embodiment of the plastic component 38 of the stationary blade 22 is further detailed and described. As can be best seen in FIG. 12, the inclined portions 116*a*, 116*b* may basically extend for the whole (lateral) length of the plastic component 38. The leading edges 30*a*, 30*b* may generally extend between a first lateral protection element 42 and a second lateral protection element 42 that are arranged at opposite (lateral) ends of the plastic component 38. A recessed portion of the plastic component shown in FIG. 9 which basically defines a bottom side of the guide slot 96 is generally covered by the metal component 40, refer to FIG. 2.

As can be best seen from FIG. 13, the central portion 118 between the inclined portions 116*a*, 116*b* may generally extend along a substantial portion of the entire (lateral) length of the plastic component 38. However, alongside the central portion 118, at least one opening slot 120 may be provided. According to the embodiment shown in FIG. 12 and FIG. 13, the central portion 118 may be arranged between a first opening slot 120*a* and a second opening slot 120*b*. The opening slots 120*a*, 120*b* may define at least one opening through which, in the assembled state, the cutter 24 may be contacted by the transmitting member 70. As can be best seen in FIG. 12, the plastic component 38 may further comprise at least one guide element 122, particularly a plurality of guide elements 122 that may be configured to guide the connector bridge 74 and, consequently, the cutter 24 connected thereto. In one embodiment, the plurality of guide elements 122 may be arranged in pairs, wherein respective pairs are arranged at laterally offset ends of the central portion 118. The guide elements 122 may be arranged as basically vertically extending convexly shaped profiles. The guide elements 122 may define a longitudinal position of the transmitting member 70 and the cutter 24. However, in connection with the embodiment(s) that implement the intermediate wall 44 that may be configured to define the longitudinal position of the cutter 24 the guide elements 122 may be spaced further apart from each other. As a consequence, the transmitting member 70 and the connector bridge 74 thereof do not have to be in permanent guide contact with the guide elements 122. Rather, the guide elements 122 may provide for rough longitudinal orientation while the intermediate wall 44 may ensure accurate longitudinal positioning of the cutter 24. In the final assembled state of the blade set 20, there may be sufficient longitudinal clearance between the guide elements 122 and the connector bridge 74. Consequently, an over-determined assembly of the cutter 24 and the stationary blade 22 may be avoided.

It is further worth mentioning in this regard that the central portion 118 and particularly the at least one opening slot 120 for the transmitting member 70 may be differently configured in alternative embodiments. By way of example, in one embodiment, the central portion 118 is interrupted by a single opening slot 120 through which the connector bridge 74 may contact the cutter 24. It is therefore emphasized that the connector bridge 74 of the transmitting member 70 does not necessarily have to comprise two contact spots for the cutter 24 that are considerably spaced from each other in the lateral direction Y, as can be seen in FIG. 3. Rather, the connector bridge 74 may also contact the cutter 24 at a (lateral) central portion.

Figure 14:
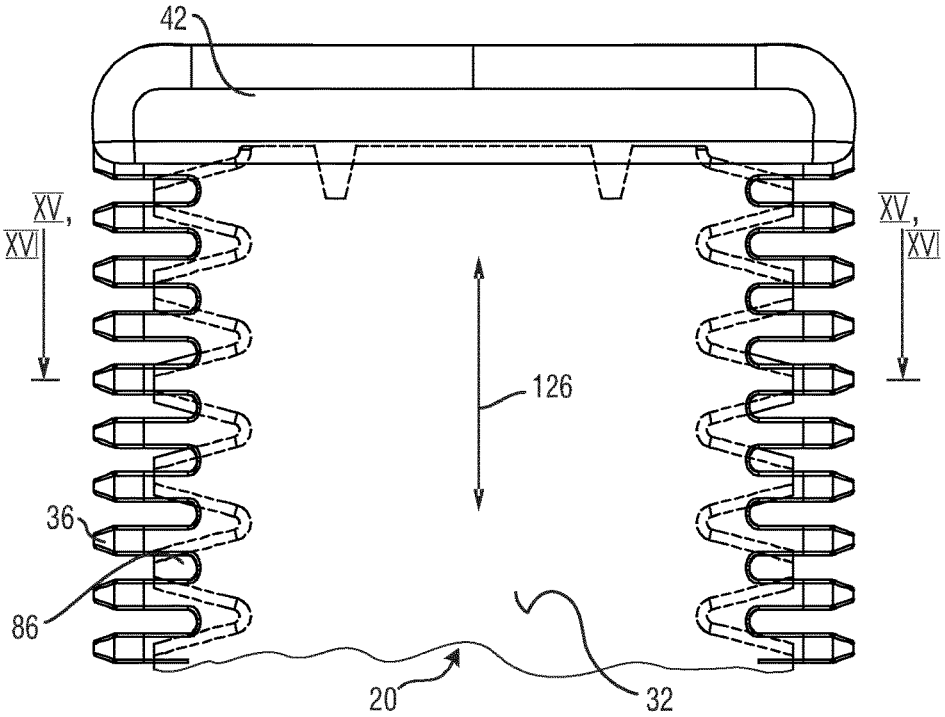
FIG. 14 is a partial top view of a blade set that is similar to the blade set as shown in FIG. 3 and FIG. 4, wherein hidden contours of a cutter thereof are indicated by dashed lines primarily for illustrative purposes.

With particular reference to FIGS. 14, 15 and 16, the blade set 20 including the stationary blade 22 being fitted with the movable blade 24 is further detailed and described. FIG. 14 is a partial top view of the blade set 20, wherein hidden contours of the cutter 24 are indicated by dashed lines. FIG. 15 is a cross-sectional view of the arrangement shown in FIG. 3, wherein the section involves a tooth 36 at the stationary blade 22 and a tooth slot at the cutter 24, refer to the line XV-XV in FIG. 14. FIG. 16 is a cross-sectional view of the arrangement shown in FIG. 4, wherein the section involves a tooth 36 at the stationary blade 22 and a tooth slot at the cutter 24, refer to the line XVI-XVI in FIG. 14. Consequently, FIG. 15 and FIG. 16 therefore basically illustrate similarly oriented cross-sections (same line in FIG. 14) of slightly different embodiments. The cutter 24 can be driven with respect to the stationary blade 22 in a reciprocating manner, refer to a double-arrow indicated by 126 in FIG. 14. Upon relative motion of the stationary blade 22 and the cutter 24, the respective teeth 36 and 82 may cooperate to cut hairs that enter the respective tooth slots.

The transmitting member 70 which is basically configured to transmit the driving motion to the cutter 24 may extend through the stationary blade 22, particularly through the at least one opening slot 120 associated with the central portion 118 of the stationary blade 22, refer to FIG. 13. FIG. 16 further shows a pair of guide elements 122 that may guide the transmitting member 70 and, consequently, the cutter 24. In some embodiments, the guide elements 122 may define the longitudinal position of the transmitting member 70 and the cutter 24 at the stationary blade 22. In some embodiments, the longitudinal position of the cutter 24 at the stationary blade 22 may be defined by a cooperation of the intermediate wall 44 of the stationary blade 22 and the guide opening 46 of the cutter 24.

It is particularly preferred that, at least in some embodiments, the cutter 24 is arranged in the guide slot 96 in a defined manner. It may be further preferred that no further mounting member, particularly no biasing member is required for keeping the cutter 24 in its desired position and in close contact with the first wall 100. This may be achieved since the stationary blade 22 is provided with the first wall 100 and the second wall 102 opposite to the first wall 100. Both walls 100, 102 may define a precise mating slot for the cutter 24, particularly for the teeth 82 thereof, such that the vertical position (Z-position) of the cutter 24 may be defined at close tolerances. This may significantly reduce manufacturing and assembly costs of the blade set 20.

By way of example, the stationary blade 22 and the cutter 24 may be configured such that the cutter 24 at least sectionally contacts the first wall 100 in a substantially planar fashion. This may particularly apply to respective tooth portions. It is worth mentioning in this connection that such a configuration does not require perfect surface contact in practice when the blade set 20 is operated. By contrast, it may be assumed that the stationary blade 22 and/or the cutter 24 may be flexed or preloaded, at least when in operation, such that only small contact areas remain. However, the first wall 100 may serve at least as a defined limit stop for the cutter 24 in the (vertical) direction Z. The first wall 100 and the second wall 102 may define a resulting gap or height dimension at the guide slot 96 for the cutter 24. The resulting gap $l_{cl}$ (refer to FIG. 8) may be defined such that a defined clearance for the to-be-mounted cutter 24 is provided. Consequently, the cutter 24 may be arranged at the stationary blade 22 without significant preload, at least in an inactive state. However, in another embodiment, the gap or height dimension for the to-be-mounted cutter blade 24 in the slot 96 may be defined such that basically an interference fit is provided. Consequently, the cutter 24 may be at least slightly preloaded by the stationary blade 22. The height dimension or thickness dimension $l_t$ (refer also to FIG. 15) of the cutter 24, at least at the at least one toothed leading edge 80 thereof, may be in the range of 0.1 mm to 0.18 mm. According to the embodiment shown in FIG. 16, the height of the guide portion 52 of the intermediate wall 44 precisely sets the resulting gap or height for the cutter 24. Hence, the second wall 102 (or: the plastic component 38) is of minor influence on the resulting gap.

Figure 17A:
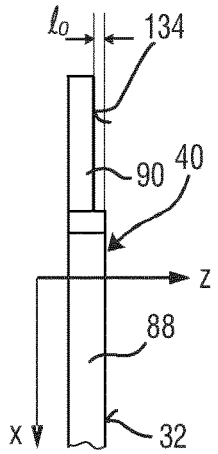
FIGS. 17*a*, 17*b* show side views of exemplary anchoring elements of metal components of a stationary blade.
Figure 17B:
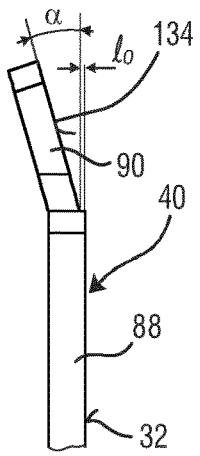
Figure 18:
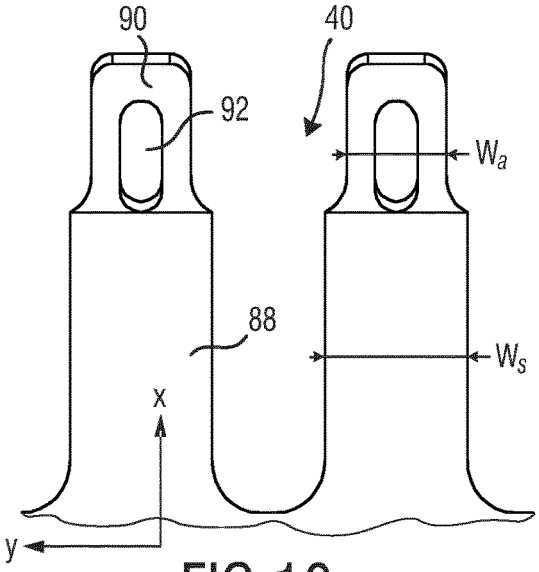
FIG. 18 to 20 show a partial bottom views of exemplary tooth stem portions and anchoring elements of metal components of a stationary blade.
Figure 19:
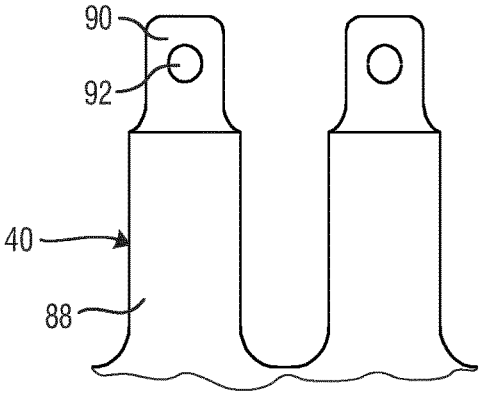
Figure 20:
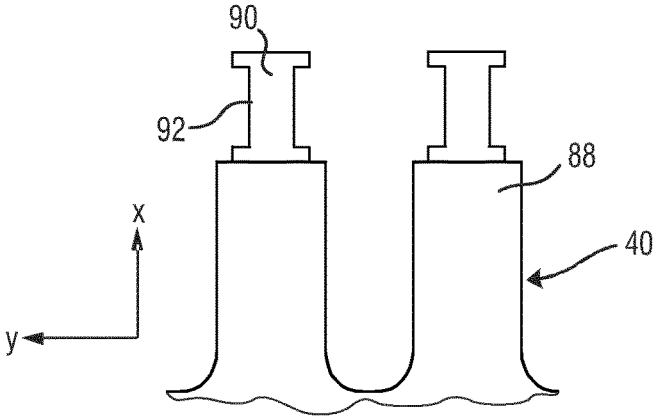

FIGS. 17*a* to 20 illustrate further advantageous alternative embodiments of metal components 40 that may serve at least as a substantial portion of the first wall 100. FIG. 17*a* and FIG. 17*b* show side views of exemplary tooth stem portions 88 from which anchoring elements 90 are extending. FIGS. 18 to 20 illustrate bottom views of exemplary tooth stem portions 88 from which respective anchoring elements 90 protrude. As already explained in connection with the embodiment of the stationary blade 22 illustrated in FIGS. 5 to 10, it may be advantageous to form the anchoring elements 90 such that the plastic component 38 of the stationary blade 22 may entirely cover the anchoring elements 90, i.e. the sides thereof that protrude from the tooth stem portions 88. Since it is further preferred that the top surface 32 (refer to FIG. 2) of the stationary blade 22 is basically planar or even or, more generally, comprises a smooth surface except for the lateral protection elements 42 (if any), it is advantageous to provide some space or offset a the top side 134 of the anchoring elements 90 such that the plastic material may also cover the top side 134 when molding. It is worth mentioning in this connection that the preferred planar or even shape of the top surface 32 does not necessarily exclude that, in practice, the first wall 100 and the top surface 32 thereof may be slightly curved or bended. By contrast, at least in some embodiments, it may be envisaged that the first wall 100 exhibits a slightly convex longitudinal extension.

FIG. 17*a* illustrates an embodiment of the stationary blade 40, wherein the anchoring element 90 is offset from the top surface 32, particularly offset in a substantially parallel manner. A resulting offset dimension $l_o$ is indicated in FIG. 17*a*. The offset dimension $l_o$ may be in the range of about 0.03 mm to about 0.1 mm, for instance. FIG. 17*b* illustrates a further alternative embodiment of anchoring elements 90 at tooth stem portions 88 of the metal component 40. As with the embodiment illustrated in FIG. 17*a*, the tooth stem portion 90 illustrated in FIG. 17*b* may be offset from the top surface 32 of the metal component 40. Furthermore, the anchoring element 90 may be inclined or bended with respect to the tooth stem portion 40. A vertical offset dimension is indicated in FIG. 17*b* by $l_o$. An inclination angle is indicated in FIG. 17*b* by $\alpha$ (alpha). By way of example, the offset dimension $l_o$ may be in the range of about 0.03 mm to 0.08 mm. The inclination angle $\alpha$ is preferably an acute angle. By way of example, the inclination angle $\alpha$ may be in the range of about 10° (degrees) to about 35° (degrees).

FIG. 18 illustrates a bottom view of tooth stem portions 88 including anchoring elements 90 that may be formed according to the embodiment shown in FIG. 17*b*. The tooth stem portions 88 may comprise a lateral extension or width $w_s$ that is greater than a lateral extension or width $w_a$ of the anchoring elements 90. The extension $w_a$ may be selected such that the plastic material of the plastic component 38 may cover also (lateral) surfaces of the anchoring elements 90 without exceeding the width $w_s$ of the tooth stem portions 88. It is generally preferred that the anchoring elements 90 comprise some recessed features, particularly barbed features, so as to allow a tight coupling of the anchoring elements 90 and the plastic component 38. The anchoring elements 90 may be provided with holes, slots or, more particularly, with slot holes 92. Hence, plastic material may enter the respective recesses 92. Consequently, the metal component 40 and the plastic component 38 may be connected at the respective bonding portions in a firmly bonded and, additionally, in a form-fit manner. FIG. 19 and FIG. 20 illustrate further embodiments of anchoring elements 90 for tooth stem portions 88. By way of example, the anchoring elements 90 illustrated in FIGS. 19 and 20 may be formed according to the embodiment shown in FIG. 17*a*. The anchoring element 90 of FIG. 19 may comprise recessed portions 92 formed as holes, particularly as cylindrical holes. The anchoring elements 90 illustrated in FIG. 20 may involve recessed portions 92 that are arranged as lateral recesses. Consequently, the anchoring elements 90 may involve a necking portion at their longitudinal extension. For instance, the anchoring elements 90 may basically comprise a H-shaped form (rotated by 90°).

It is generally preferred that the anchoring elements 90 are provided with form-fit elements so that the metal component 40 and the plastic component 38 may be connected as the anchoring elements in a bonded but also in a form-fit manner.

Figure 21:
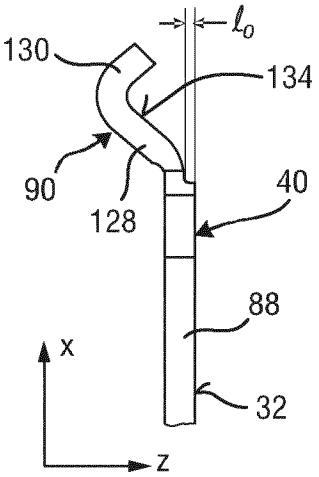
FIGS. 21 and 22 show a side view and a partial bottom view of another exemplary anchoring element of a metal component of the stationary blade.
Figure 22:
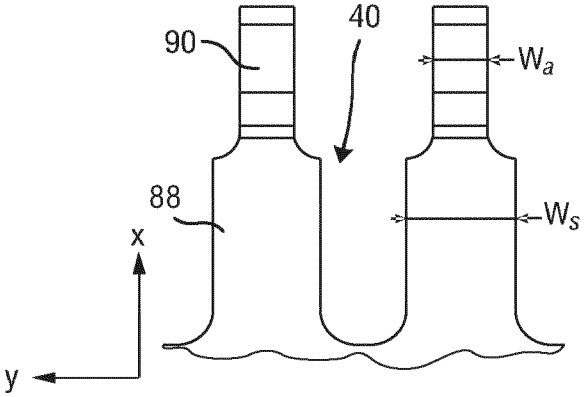
Figure 23:
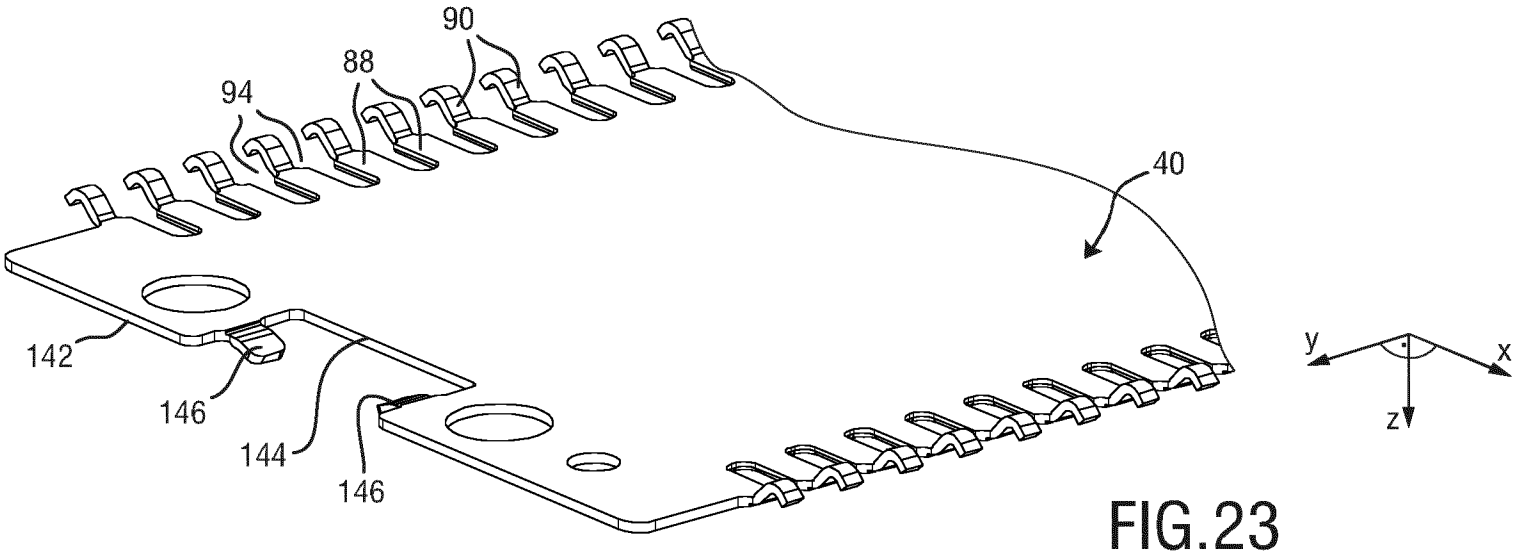
FIG. 23 is a partial perspective bottom view of a metal component of the embodiment of the metal component of the stationary blade shown in FIGS. 21 and 22.

Further reference is made to FIGS. 21 to 23, illustrating a further beneficial embodiment of a metal component 40 for a metal-plastic composite stationary blade 22. As illustrated and explained above, it is particularly preferred that anchoring elements 90 are provided at the tooth stem portions 88 of the metal component 40, particularly at longitudinal ends of the tooth stem portions 88. That anchoring elements 90 as shown in FIG. 21 and FIG. 22 may ensure a reliable fixed coupling, particularly a basically undetachable bonding, between the metal component 40 and the plastic component 38. It is further preferred that the anchoring elements 90 provide some undercut geometry (particularly when viewed in a plane that is perpendicular to the longitudinal direction X) that basically acts as a hook or a barbed hook to ensure a tight fit of the plastic material at the tooth stem portions 88 via the anchoring elements 90.

As can be seen from the side view of FIG. 21 and the bottom view of FIG. 22, the anchoring elements 90 may exhibit a curved shape, particularly a hook-like shape. More particularly, the anchoring elements 90 may comprise a first inclined portion 128 and a second inclined portion 130. Both the first inclined portion 128 and the second inclined portion 130 may be connected to or merge into each other at a transition region, particularly a curved or rounded transition region. When viewed in a plane that is perpendicular to the lateral direction Y, the anchoring elements 90 may comprise basically constant (cross-) sections. In other words, the first inclined portion 128 and the second inclined portion 130 may be inclined with respect to the longitudinal direction X. Further, the first inclined portion 128 and the second inclined portion 130 may be reversely inclined with respect to each other. Hence, the hook-like shape of the anchoring elements 90 may fixate the plastic material thereto. For instance, starting from a respective tooth stem portion 88, the first inclined portion 128 may be inclined towards to bottom side and the second inclined portion 130 may be inclined to the top side.

The tooth stem portions 88 may comprise a lateral extension or width $w_s$ that is greater than a lateral extension or width $w_a$ of the anchoring elements 90. In this respect, reference is made to FIG. 18. It may be further advantageous to provide some space or offset at the top side 134 of the anchoring elements 90 such that the plastic material may also cover the top side 134 when molding. Preferably, the plastic material may totally cover the anchoring elements in the bonded state. To this end, a respective anchoring element 90 may be offset from the top surface 32, refer also to the offset dimension $l_o$ in FIG. 21.

The anchoring elements 90 according to the embodiment illustrated in FIGS. 21 to 23 may have the advantage that no particular recess needs to be processed therein (refer to the recesses or holes 92 in FIGS. 18 to 20). This may further simplify manufacturing the metal component 40. By way of example, the anchoring elements 90 of FIGS. 21 to 23 may be obtained through a material forming process, particularly by cold forming. Hence, no material removing process is necessary to shape the curved anchoring elements 90. This may further avoid relatively complex etching processes, for instance. By way of example, a raw shape of the metal component may be obtained through a cutting process, particularly a stamping process. The raw part may be then further shaped by applying material forming processes thereto. Also combined stamping and bending processes may be envisaged in this context.

A partial perspective view of a metal component 40 that is provided with respective curved anchoring elements 90 is shown in FIG. 23. In the final manufacturing state, the anchoring elements 90 will be covered by the plastic component 38. FIG. 23 further illustrates a lateral end 142 of the metal component 40. Generally, the metal component 40 may comprise two opposite lateral ends 142. At a central portion of the lateral end 142 a notch or recess 144 may be provided. The notch 144 may be basically quadrangular or rectangular. Generally, the notch 144 may be referred to as a lateral slot in the lateral end 142 of the metal component 40. As indicated above, a respective lateral protection element 42 may be attached to the lateral end 142 of the metal component 40, see also FIGS. 3 to 5. Preferably, the lateral protection element 42 is integrally provided in the plastic component 38. Consequently, it may be beneficial to provide similar anchoring elements 146 at the notch 144. The anchoring elements 146 may be also referred to as side protector anchoring elements 146. The anchoring element 146 may be at least partially curved or inclined with respect to the longitudinal direction X. As can be further seen from FIG. 23, preferably two anchoring elements 146 at opposite ends of the notch 144 are provided. This may further strengthen the fixation of the lateral protection element 42 at the lateral end 142. Since the anchoring elements 146 are oppositely oriented (and therefore oppositely inclined), and since they are covered by the same lateral protection element 42 in the molded state, it is not absolutely necessary to provide the anchoring elements 146 with two oppositely inclined portions. Also the anchoring elements 146 at the notch 144 may be obtained through a forming process, particularly a cold-forming process. The notch including 144 raw anchoring elements may be obtained through a cutting process, particularly a stamping process.

Figure 25:
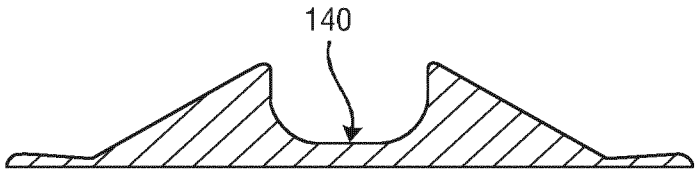
FIG. 25 illustrates a cross-section of a substitute component that is configured to form a guide slot at the stationary blade shown in FIG. 24.
Figure 24:
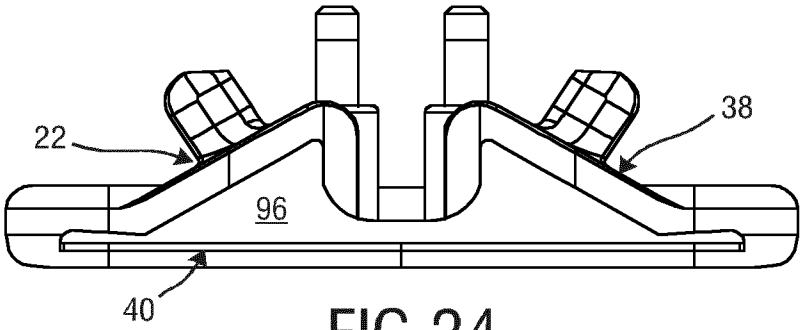
FIG. 24 shows a side view of a stationary blade as shown in FIG. 3 and FIG. 4, whereas for illustrative purposes no intermediate wall is illustrated in FIG. 24.
Figure 26:
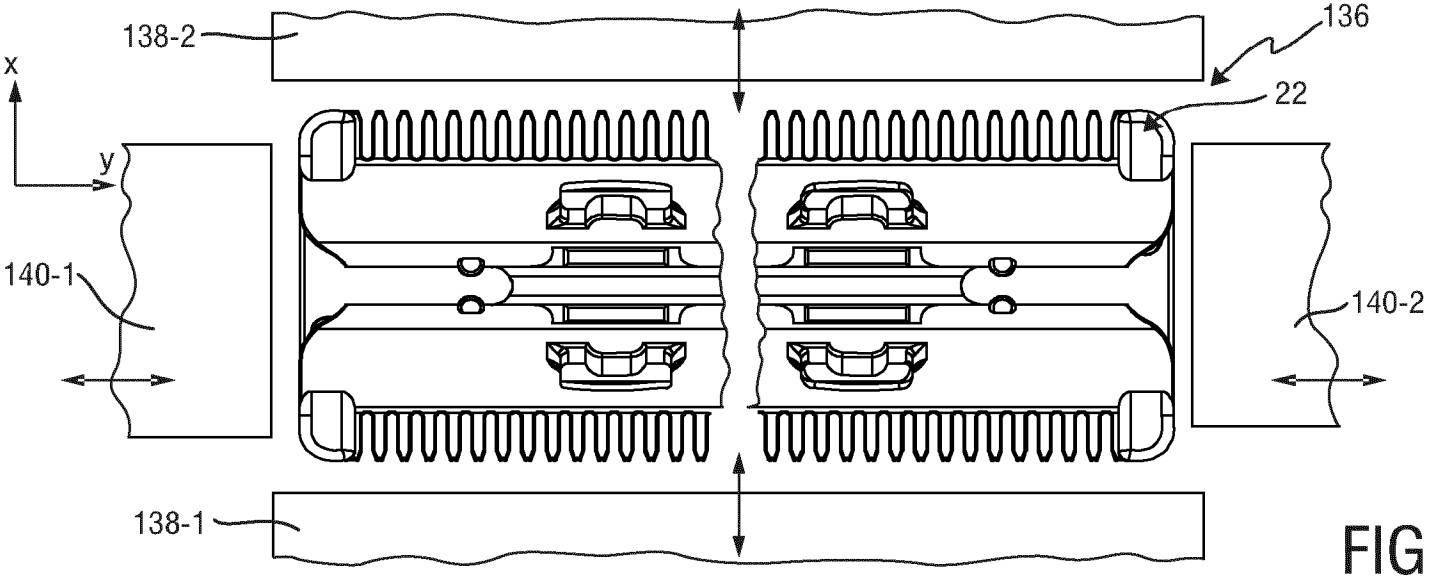
FIG. 26 is a broken bottom view of the stationary blade illustrated in FIG. 24, wherein mold halves and sliders of a mold for molding the stationary blade are indicated by partially shown blocks primarily for illustrative purposes.

With reference to FIGS. 24, 25 and 26, manufacturing-related aspects of the stationary blade 22 will be illustrated and further detailed. FIG. 24 is a side view of the stationary blade 22 including the plastic component 38 and the metal component 40. The plastic component 38 and the metal component 40 jointly defined a shell surrounding the guide slot 96 for the movable blade 24, refer also to FIG. 15 and FIG. 16. FIG. 25 illustrates a sectional area of the guide slot 96 for illustrative purposes. Manufacturing the stationary blade 22 may basically comprise inserting the metal component 40 into a mold, filling the space required for the guide slot 96 and molding the plastic component, particularly injection-molding the plastic component 38, thereby bonding the plastic component 38 to the metal component 40. The cavity that basically defines the guide slot 96 may be filled with a so-called substitute component 140, shaped according to the section shown in FIG. 25. The substitute component 140 may also be regarded as a dummy component 140. The substitute component 140 may be inserted into the mold for the plastic component 38 and occupy the space of the guide slot 36. The substitute component 140 may generally be arranged as a re-usable substitute component or a non-substitute component which may also be referred to as lost substitute component.

Further reference is made to FIG. 26 comprising a broken bottom view of the stationary blade 22 and a schematic illustration of a mold 136 for the stationary blade 22. By way of example, the mold 136 for forming the stationary blade 22 may involve two (main) mold halves 138-1, 138-2 that are arranged to be moved to each other into close contact, thereby defining the molding cavity for the stationary blade 22, particularly for the plastic component 38 thereof. Refer also to respective arrows in FIG. 26 indicating the respective (longitudinal) motion of the mold halves 138-1, 138-2. In case the substitute component 140 is arranged as a re-usable component, the substitute component 140 may be embodied by at least one slide, particularly by at least one laterally movable slide 140-1, 140-2.

It should be understood that further alternative tooling concepts and/or demolding approaches may be envisaged. For instance, at least a central portion of the plastic component 38 may be demolded in the Z-direction. Consequently, also respective slides may be present in the mold for the stationary blade 22.

In another embodiment, the substitute component 140 may be arranged as a component that is separate from the mold 136. In other words, the substitute component alternatingly may be arranged as an insert component that may be inserted into the cavity defined by the mold 136 along with the metal component 40. However, it is preferred that such an insert substitute component 140 is removable from the molded stationary blade 22 after molding, cooling down and removing the stationary blade 22 from the mold 136. Thus, the substitute component 140 may be a re-usable substitute component.

Figure 27:
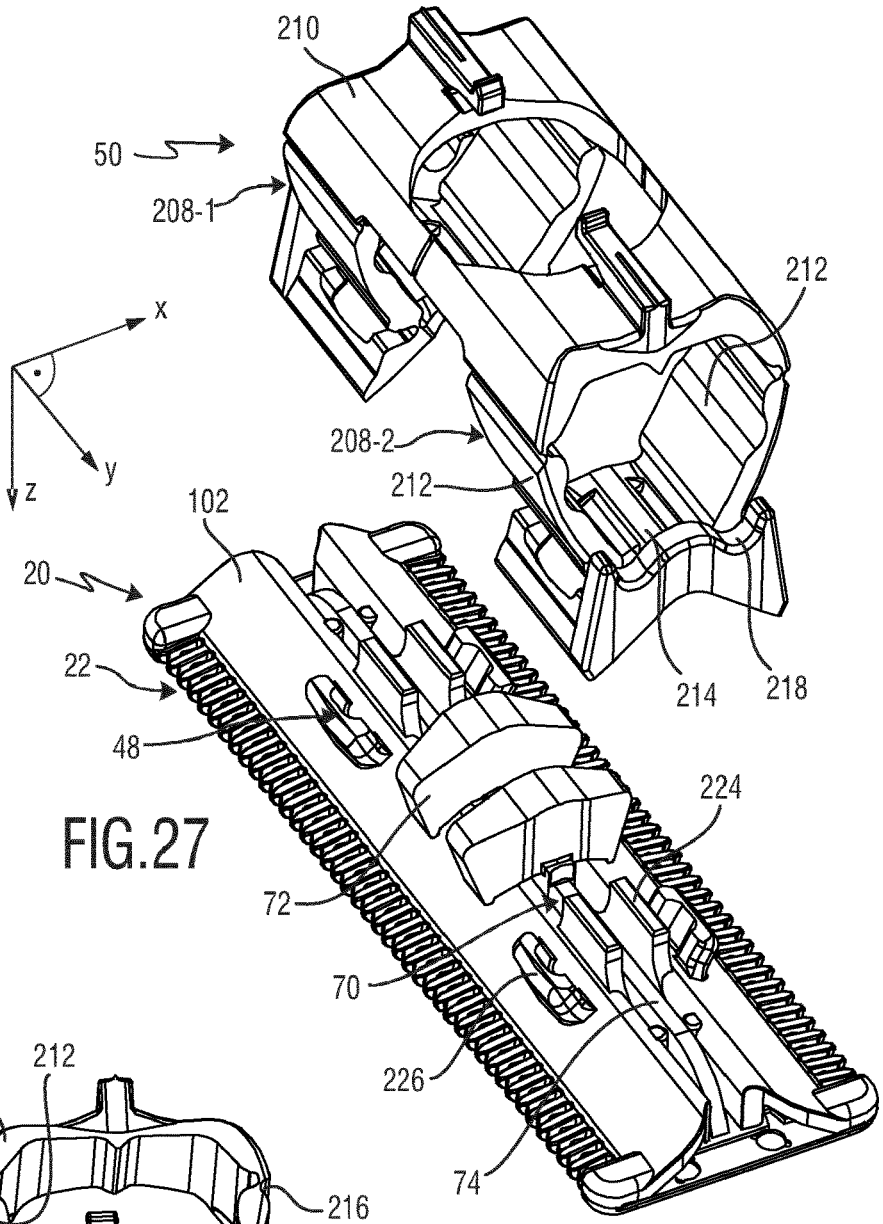
FIG. 27 is a perspective bottom view of an arrangement of the blade set and the linkage mechanism shown in FIG. 2, the blade set being detached from the linkage mechanism.

FIGS. 27 to 30 illustrate further beneficial embodiments of the blade set 20, particularly of the stationary blade 22 thereof. As already indicated above, at least a substantial portion of the stationary blade 22 may be formed by the plastic component 38. Further functions may be integrated into the stationary blade 22 without the need of adding or mounting further parts to the stationary blade 22. FIG. 27 illustrates a bottom perspective view of the blade set 20 including the stationary blade 22 and the movable blade 24 and the transmitting member 70 being mounted thereto. FIG. 27 further illustrates a linkage mechanism 50 to which the blade set 20 may be attached, refer also to FIG. 2. In FIG. 27, the blade set 20 is shown in a released or detached state.

As shown in FIG. 27, the linkage mechanism 50 may be arranged as a four-bar linkage mechanism. The linkage mechanism 50 may comprise at least one linkage element 208, particularly a first linkage element 208-1 and a second linkage element 208-2 that are laterally spaced from each other in the lateral direction Y. The at least one linkage element 208 may comprise a base 210 which may also be referred to as a contact element for connecting the linkage mechanism 50 and the housing 12 of the cutting appliance 10, refer also to FIG. 1. The linkage element 208 may further comprise a top portion or top 214 that is arranged opposite to the base 210. The linkage element 208 may further comprise coupling elements that connect a base 210 and a top 214. For instance, the linkage element 208 may comprise two coupling arms 212 each of which may be arranged between the base 210 and the top 214. The coupling arms 212 may be longitudinally spaced from each other in the longitudinal direction Y. The base 210 and the top 214 may be spaced from each other in the vertical or height direction Z. In one embodiment, the respective members of the linkage element 208 may be coupled to each other via film hinges 216.

The stationary blade 22 may be provided with mounting elements 48, particularly at the second wall 102 thereof, such that the second wall 102 may contact the top 214 of the linkage element. Consequently, the blade set 20 and the top 214 may jointly swivel or pivot with respect to the base 210 of the at least one linkage element 208. At the top 214 of the linkage element 208, a limit stop arrangement 218 may be provided.

Figure 28:
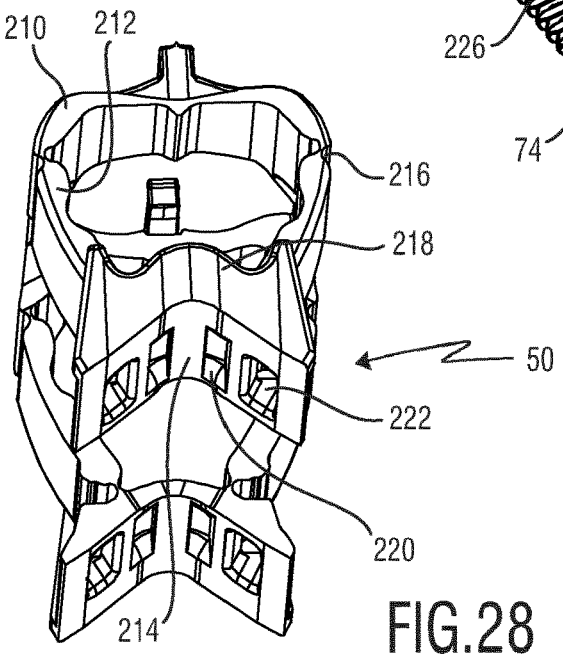
FIG. 28 illustrates a perspective top view of the linkage mechanism shown in FIG. 27, wherein mounting elements of the linkage mechanism are shown.
Figure 29:
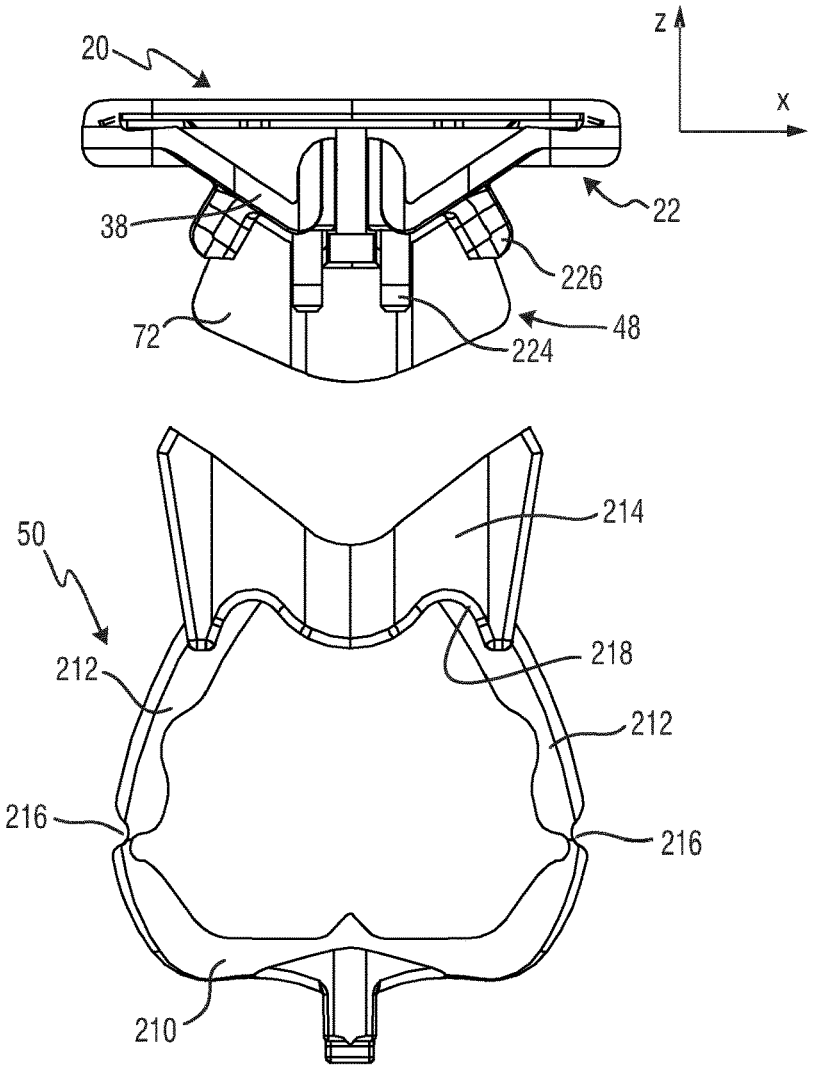
FIG. 29 is a side view of an arrangement of a blade set and a linkage mechanism as shown in FIG. 27.
Figure 30:
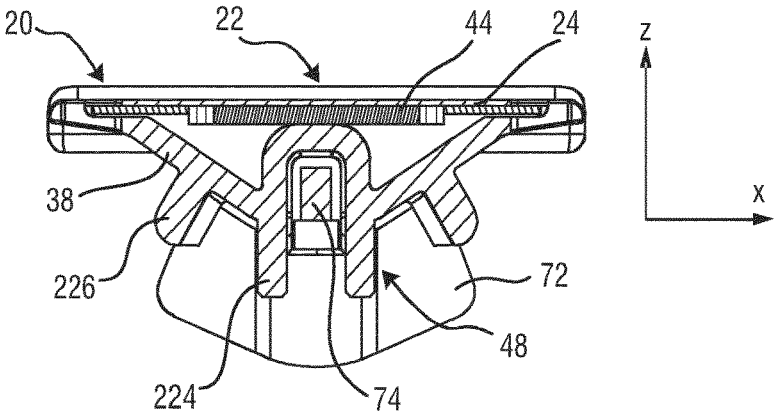
FIG. 30 is a cross-sectional side view of an embodiment of the blade set as shown in FIG. 29, illustrating mounting elements integrally formed at the stationary blade.

FIG. 28 illustrates a perspective top view of the linkage mechanism 50. FIG. 29 illustrates a side view of the arrangement shown in FIG. 27, wherein the blade set 20 is detached from the linkage mechanism 50. FIG. 30 illustrates a cross-sectional side view of the blade set 20, wherein a section through the mounting elements 48 is illustrated. As can be best seen in FIGS. 27 and 30, the mounting elements 48 may comprise at least one guide protrusion 224 and at least one mounting protrusion 226 that may be configured to cooperate with at least one respective guide recess 220 and at least one respective mounting recess 222 at the top 214 of the linkage element 208 (refer to FIG. 28). As can be seen from FIG. 29, the blade set 20 may be basically vertically fed to the linkage mechanism 50 for attachment.

As exemplarily shown in FIGS. 27 to 30, each of the linkage elements 208-1, 208-2 may be associated with a respective set of mounting elements 48. Each set of mounting elements 48 may comprise a pair of guide protrusions 224 and a pair of mounting protrusions 226 that may be arranged to cooperate with respective pairs of guide recesses 220 and mounting recesses 222 at each of the linkage elements 208-1, 208-2.

Figure 31:
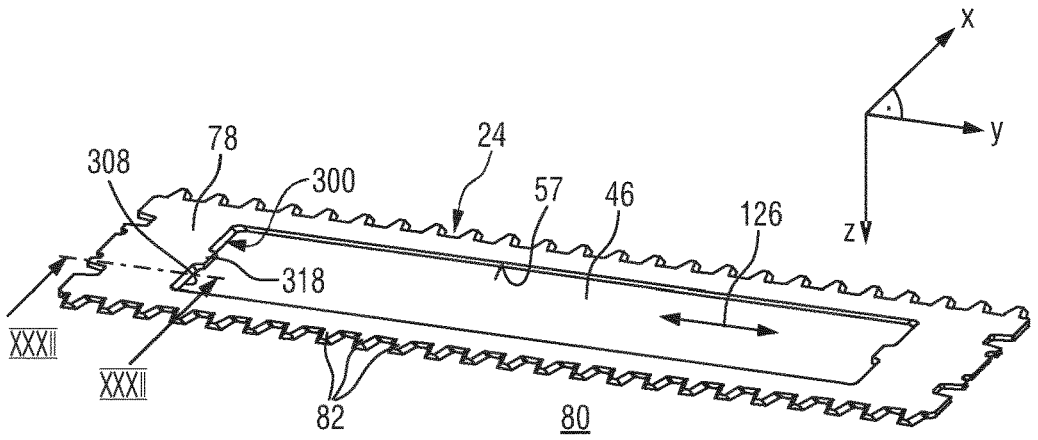
FIG. 31 is a perspective bottom view of an embodiment of a cutter that is provided with scraping portions.
Figure 32:
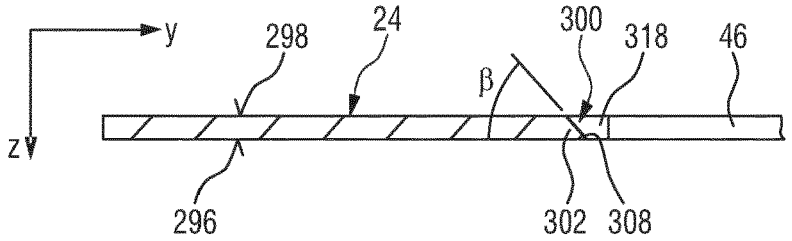
FIG. 32 is a partial cross-sectional longitudinal side view of the cutter as shown in FIG. 31 taken along the line XXXII-XXXII in FIG. 31.

With reference to FIGS. 31 to 39, arrangements of cutters 24 will be elucidated and further detailed. FIG. 31 is a perspective bottom view of a first embodiment of cutter 24. As with the embodiment of FIG. 11, the cutter 24 comprises a laterally extending guide opening 46 which may be arranged to encompass an intermediate wall 44. A direction of a cutting motion of the cutter 24 with respect to a corresponding blade set 22 is indicated in FIG. 31 by a double arrow that is designated by reference numeral 126.

The cutter 24 is provided with at least one scraping portion 300 which is provided at a lateral end surface of the guide opening 46. Similarly, a corresponding scraping portion 300 may be provided at the opposite lateral end surface of the guide slot 46 (not visible in FIG. 31). Further reference in this respect is made to FIGS. 32 and 33. However, the at least one scraping portion 300 does not necessarily have to be arranged at the guide opening 46. As can be best seen from FIG. 32, a top side surface 296 and bottom side or second surface 298 may be defined at the cutter 24, particularly at the relatively flat or planar main portion 78 thereof.

As used herein, the top side or first surface 296 is the side that is facing the first wall 100 of the stationary blade 22, refer also to FIG. 7 and FIG. 8. Consequently, the bottom side or second surface 298 is the side that is facing the second wall 102 of the stationary blade 22. As can be further seen from FIG. 32, the scraping portion 300 comprises a tapered or triangular scraper profile 302. The scraper profile 302 comprises a tip edge 308 that is arranged at the first surface 296. Consequently, the scraper profile 302 may be used to scrape off accumulated dirt and debris from the first wall 100. The scraper profile 302 comprises an angle of inclination β (beta) that defines a degree of sharpness of the tip edge 308. By way of example, the angle of inclination β may be arranged as an acute angle. Generally, the angle β may be in the range of about 5° (degrees) to about 60°. Preferably, the angle β is in a range of about 10° to about 45°. More preferably, the angle β is in the range of about 15° to about 30°. Generally, the tip edge 308 may be processed to be relatively sharp so as to be able to scrape off or push off accumulated material that adheres to the first wall 100 of the stationary blade 22.

Figure 33:
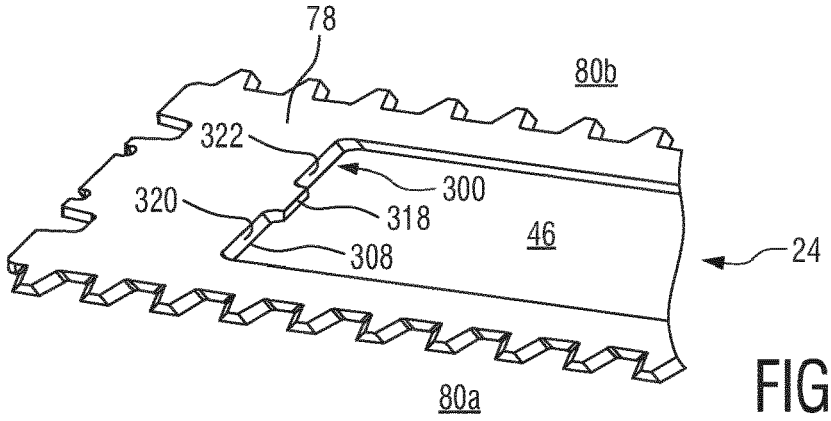
FIG. 33 is a detailed view of the arrangement of FIG. 31.
Figure 34:
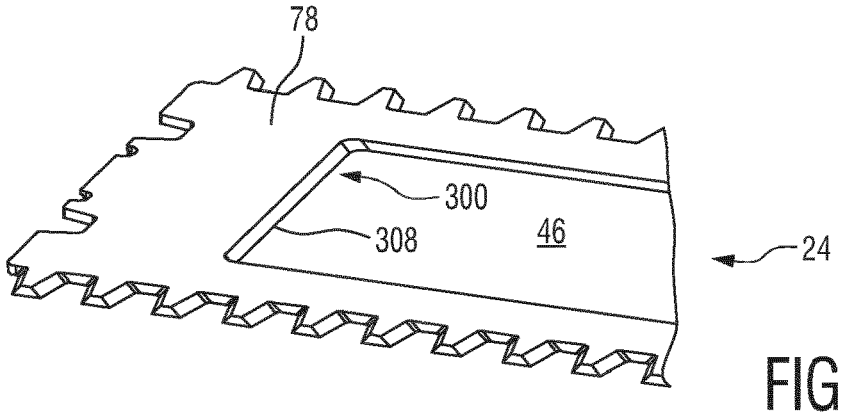
FIG. 34 is a detailed partial perspective bottom view of an alternative embodiment of a cutter that is provided with at least one continuous scraping portion.

Further reference is made to FIG. 33, and to FIG. 34 which illustrates an alternative embodiment. As with the embodiment of FIGS. 31 to 33, an abutment tab 318 is provided at the scraping portion 308 that is arranged at the lateral end of the guide opening 46. As a consequence, the scraper profile 302 is interrupted. The abutment tab 318 is arranged between a first section 320 and a second section 322 of the scraper profile 302. Since the abutment tab 318 protrudes beyond the scraper profile 302 in the longitudinal direction Y (refer to FIG. 32), the scraper profile 302, particularly the tip edge 308 thereof, may be protected from contacting the intermediate wall 44, particularly lateral end surfaces thereof (refer to FIG. 11 in this context).

Further, the abutment tab 318 may be useful when the intermediate wall 44 and the cutter 24 are jointly inserted into the guide slot 96 that is defined by the first wall 100 and the second wall 102 of the stationary blade, as is the case with at least some embodiments of manufacturing methods as discussed herein. The abutment tab 318 may further prevents the scraper profile 302 from reaching under the intermediate wall 44, which could be the case at a stage of the manufacturing process when the intermediate wall 44 is not yet fixedly attached or bonded to the first wall 100.

However, as with the embodiment illustrated in FIG. 34, also embodiments of the cutter 24 may be envisaged that comprise scraping portions 300 that are basically (longitudinally) extending in a continuous fashion. Generally, it is preferred that the scraping portions 300, particularly the scraper profiles 302 thereof, at least partially extend in the longitudinal direction X that is perpendicular to the direction of the cutting motion (reference numeral 126 in FIG. 31). This of course may involve that the scraping portion 300 extends in a fashion basically parallel to the longitudinal direction X. However, there may be further embodiments, wherein the main extension of the scraping portions 300 is at least slightly inclined with respect to the longitudinal direction X.

Further reference is made to FIGS. 35 to 39 illustrating schematic broken cross-sectional longitudinal side views of cutters 24 that implement alternative embodiments of scraping portions 300. More particularly, FIGS. 35 to 39 further detail alternative shapes and arrangements of respective scraper profiles 302, 304, 306 that are provided at the scraping portions 300.

Generally, the scraping portions 300 including the respective scraper profiles 302, 304, 306 may be regarded as pushers or bulldozers that are arranged to clean the inwardly facing surface of the first wall 100 and/or a second wall 102. It is further emphasized in this connection that the main purpose of the respective scraping portions 300 is not to cut hairs but rather to scrape off accumulations, hair filaments, etc. at the guide slot 96 of the stationary blade 22.

Figure 35:
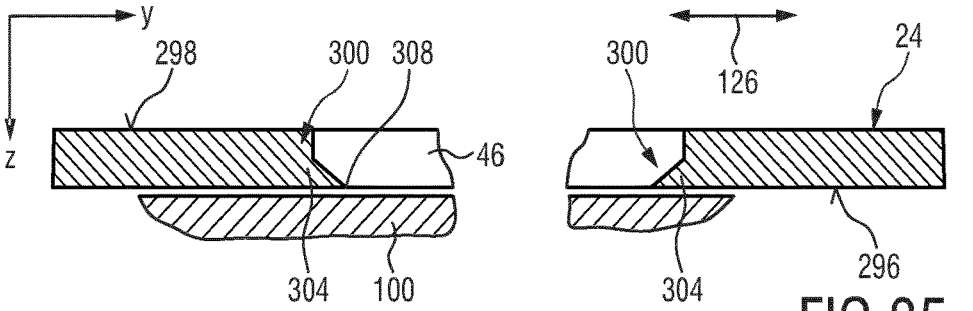
FIGS. 35 to 39 show simplified schematic broken longitudinal side views of alternative embodiments of a cutter comprising scraping portions.

Reference is made to FIG. 35. The broken view of the cutter 24 as shown in FIG. 35 shows a first lateral end and a second lateral end of the cutter 24. As with the embodiment of FIG. 34, a guide opening or guide slot 46 is provided (interrupted in FIG. 35). Further, the first wall 100 of a corresponding stationary blade 22 is schematically shown in FIG. 35. As with the embodiment of FIG. 34, the respective lateral end surfaces of the guide opening 46 are provided with scraping portions 300 that are facing each other. A respective profile or cross-sectional profile of the scraping portions is indicated by reference numeral 304. By way of example, the scraper profiles 304 comprise a kink and a tapered portion that ends at a tip edge 308. The tip edge 308 is arranged at the first surface 296 of the cutter 24 that is arranged to contact the first wall 100 so as to scrape off accumulated dirt, hair remainders, etc.

Figure 36:
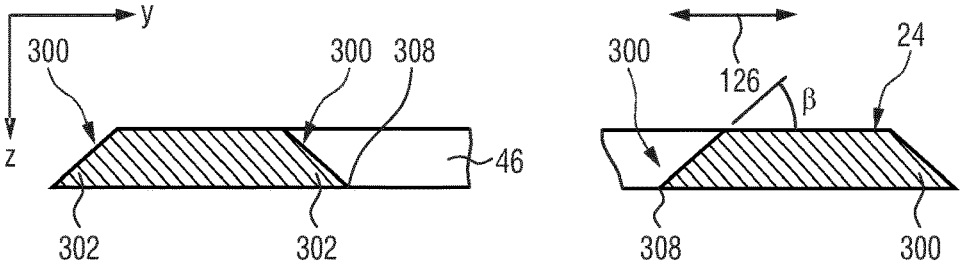

An alternate embodiment of a blade set 24 is shown in FIG. 36. As with the embodiment of FIG. 36, two pairs of scraping portions 300 are provided at the cutter 24. Again, a guide opening 46 may be provided to which two scraping portions 300 are assigned which are facing each other. Further, at the respective lateral ends of the cutter 24, respective outwardly facing scraping portions 300 are provided. The scraping portions 300 as shown in FIG. 36 comprise scraper profiles 302 that are arranged in a triangular fashion and that comprise tip edges 308 that are arranged adjacent to the first wall in the mounted state. The scraping portions 300 as shown in FIG. 36 comprise scraper profiles 302 that are arranged in a basically triangular or wedge-shaped fashion.

Figure 37:
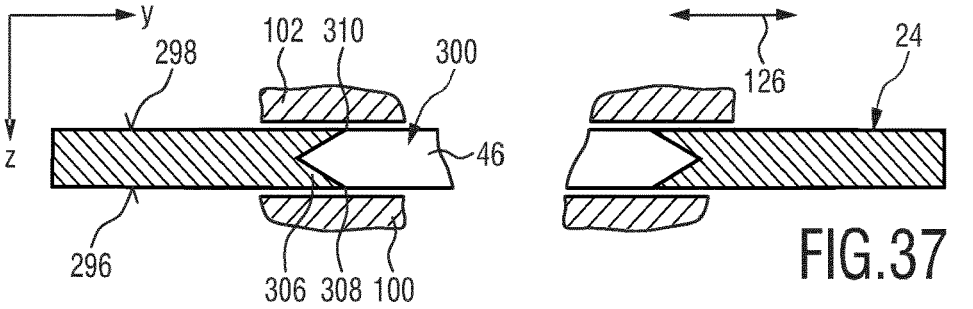

FIG. 37 illustrates a further alternative embodiment of a cutter 24 that is fitted with a plurality of scraping portions. Again, a guide opening 46 is provided. At lateral end surfaces of the guide opening 46, inwardly facing scraping portions 300 may be provided. It goes without saying that at least in some embodiments the guide opening 46 as shown in FIGS. 35 to 39 does not necessarily have to be construed as a portion of the cutter 24 that necessarily contacts a respective intermediate wall 44 of the stationary blade 22. Rather, the guide opening 46 generally may be referred to as an opening 46 that is provided at the cutter 24 so as to provide respective longitudinally extending surfaces where the scraping portions 300 may be formed. Consequently, in a more general context, the guide openings 46 may be regarded as openings. As already indicated above, the scraping portions 300 do not necessarily have to extend in a main direction that perfectly matches or is parallel to the longitudinal direction X. Rather, a main extension direction of at least some of the scraping portions 300 may be at least slightly inclined with respect to the longitudinal direction X.

The scraping portions 300 of the embodiment as illustrated in FIG. 37 are provided with scraper profiles 306 that are basically arranged in a double-wedge or double-triangular fashion. In other words, a respective cross-section may be approximately C-shaped. Consequently, the scraper profiles 306 are provided with a first tip edge 308 and a second tip edge 310 that is opposite to the first tip edge 308. The first tip edge 308 is arranged to cooperate with the first wall 100. The second tip edge 310 is arranged to cooperate with the second wall 102. The first tip edge 308 is provided at the first surface 296. The second tip edge 310 is arranged at the second surface 298.

As a consequence, the scraper profiles 306 may be arranged to clean both the first wall 100 and the second wall 102 of a corresponding stationary blade 22. This may be particularly beneficial in embodiments of the stationary blade 22, wherein not only the first wall 100 but also the second wall 102 contacts the cutter 24 in an areal fashion, i.e. at a relatively large contact surface. Such an embodiment may for instance include that both the first wall 100 and the second wall 102 are formed from metal material, particularly from sheet metal material. If this is the case, the guide slot 96 defined by the first wall 100 and the second wall 102 is relatively narrow and arranged to receive the cutter 24 in a basically close fit fashion. Consequently, also dirt or debris accumulations at the second wall 102 may impair the cutting performance of the blade set 20. Therefore, the second tip edges 310 of the scraper profile 306 may clean the second wall 102 so as to re-establish and maintain the blade set's 20 hair cutting capabilities.

The scraper profile 306 of the scraping portions 300 of FIG. 37 may be for instance formed via electro-chemical machining, for instance via etching. Even though the scraper profile 306 comprises an undercut (when viewed from the top), the respective wedge-shaped portions of the scraper profile 306 and considerably sharp tip edges 308, 310 may be formed in this way.

Figure 38:
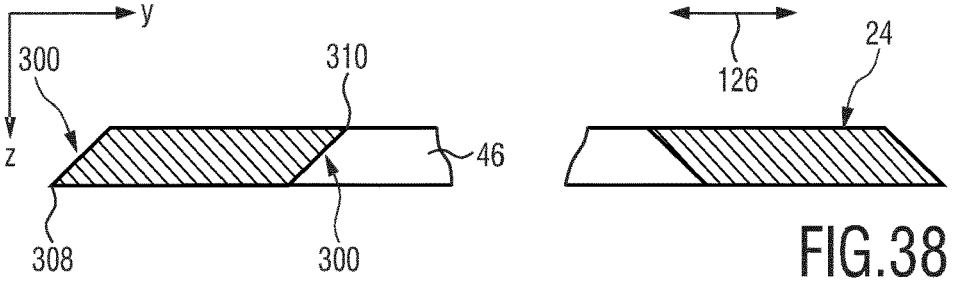

FIG. 38 shows a further alternative embodiment of a cutter 24 that comprises a plurality of scraping portions 300. Some of the scraping portions 300 are provided with scraper profiles 302 that define and form first tip edges 308 at a first side of the cutter. However, further scraping portions 300 define second tip edges 310 at their profiles that are arranged at the opposite side of the cutter 24. Consequently, as with the embodiment of FIG. 37, a first wall 100 and a second wall 102 may be cleaned. The embodiment as shown in FIG. 38 may be preferred, in some cases, from a manufacturing point of view over the embodiment as shown in FIG. 37. Basically, according to the embodiment of FIG. 38, the tip edges 308, 310 that are arranged at opposite sides of the cutter 24 are easily accessible and can be therefore manufactured with relatively little efforts.

Figure 39:
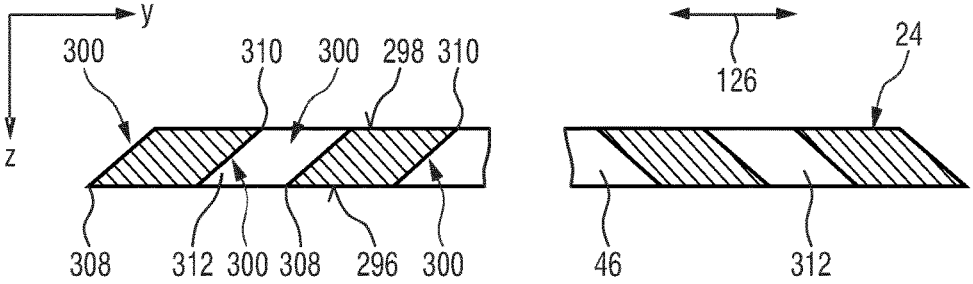

The embodiment as shown in FIG. 39 illustrates another embodiment of a cutter 24 that is provided with a plurality of scraping portions 300. In total, eight scraping portions 300 are shown in FIG. 39. As with the embodiment of FIG. 38, first tip edges 308 are arranged at the first surface 296 and second tip edges 310 are arranged at the second surface 298. Further, in addition to the guide opening 46, slots or openings 312 are provided so as to form a greater number of scraping portions 300 at the cutter 24. Further, the respective scraping portions 300 implement only one tip edge 308, 310. Needless to say, the embodiment as shown in FIG. 39 can be combined with the embodiment as shown in FIGS. 35 to 38 as well. Again, reference is made to FIG. 39. Respective tip edges 308 at the first surface 296 and tip edges 310 at a second surface 298 are spaced from one another in a defined fashion. Preferably, a respective offset between neighboring ones of the tip edges 308, 310 is adapted to a stroke length of the cutting motion, particularly of the reciprocating cutting motion of the cutter 24, refer to the double-arrow indicated by reference numeral 126 in FIG. 39. When the offset between the neighboring tip edges 308, 310 is equal to or smaller than a stroke (length) of the cutter 24, at least a substantial portion of the first wall 100 and/or a second wall 102 may be continuously cleaned as the cleaned portions are somewhat overlapping.

Further embodiments of cutters 24 may be envisaged. The cutters 24 may implement single aspects of the embodiments as discussed herein in connection with FIG. 31 to FIG. 39. By way of example, a greater number of slots 312 may be provided so as to enable a corresponding greater number of scraping portions.

Figure 40:
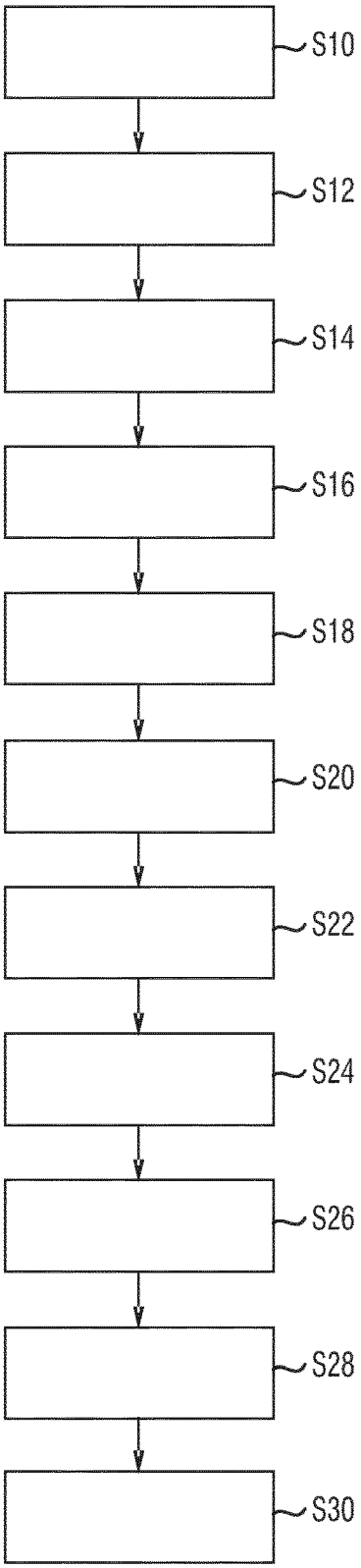
FIG. 40 shows an illustrative block diagram representing several steps of an embodiment of a method for manufacturing a stationary blade.

With reference to FIG. 40, an exemplary manufacturing method for a stationary blade 22 of a blade set 20 is illustrated and further detailed. At a first step S10 a raw material or semi-finished material for forming a metal component of the stationary blade may be provided. This may involve providing a sheet metal material. Providing a sheet metal material may further involve supplying the sheet metal material from a coil. A respective intermediate metal material may comprise a plurality of portions, each of which defining a to-be-finished metal component for the stationary blade. For instance, each of these defined precursor portions may be pre-processed by stamping or another adequate cutting method.

A further step S12 may follow which may include forming intermediate leading edges, particularly intermediate toothed leading edges of the to-be-processed metal components. By way of example, the step S12 may involve forming tooth stem portions at the leading edges. Forming the tooth stem portions may involve removing material between respective tooth stem portions so as to define slots therebetween. This may involve an adequate material-removing process, for instance stamping, laser cutting, wire cutting and etching. Further material-removing processes may be envisaged. Forming tooth stem portions at respective leading edges of the metal components may further involve forming considerably sharp cutting edges at the tooth stem portions, particularly at lateral flanks thereof. Etching the tooth stem portions may involve processing a general form of the tooth stem portions and further creating relatively sharp cutting edges at their flanks.

A further step S14 may follow which may include forming or processing anchoring portions. Preferably, the anchoring portions extend from longitudinal ends of the tooth stem portions at the leading edges. The anchoring portions preferably include recesses or similar elements that may be engaged by and filled with a moldable material. It is further preferred that the anchoring portions at the tooth stem portions are further machined at skin-facing and lateral sides thereof (refer also to FIG. 6 and to FIGS. 17 to 20) such that they may be covered by the molded or moldable component resulting in a generally smooth surface without significant steps at a transition between the anchoring portions and the tooth stem portions. It goes without saying that the steps S14 and S12 may be combined. For instance, the steps S12 and S14 may be implemented by an integrated stamping (or, alternatively, etching) step.

At a further step S16, which may be regarded as an optional step, the anchoring elements or anchoring portions may be bended with respect to the tooth stem portions. Bending the anchoring portions may further strengthen the fixation of the molded material and the metal component since more space may be provided for the plastic material. There may be at least some embodiments of the manufacturing method which do not require the step S16.

A further optional step S18 may follow which may include separating a plurality of precursors for the metal component from a respective row or array at the supplied metal material, particularly at the supplied sheet metal material, for instance at the supplied sheet metal coil.

A further step S20 may follow which may involve placing the metal component in a cavity of a molding tool. Placing the metal component may include placing the metal component in a defined orientation in the cavity of the mold. As already indicated above, the metal component may be placed in the mold cavity in its separated state. However, at least in some embodiments, placing a plurality of metal components in a mold comprising a respective plurality of cavities may be envisaged. The respective metal components of the plurality of metal components may be separated from each other. However, in the alternative, the metal components may be attached to a common supporting structure.

Having placed the metal component in the cavity of the mold, placing a substitute component in the mold may follow. The substitute component may cover or fill a space in the mold cavity to define a guide slot in the to-be-formed stationary blade. Placing the substitute component in the mold may include placing a re-usable or a non-re-usable substitute component in the mold. By way of example, the step S22 may include inserting at least one slide into the cavity of the mold. The at least one slide may be arranged as a component of the molding tool. For instance, the molding tool may be provided with two opposite slides that form the substitute component.

A further step S24 may follow which may be regarded as molding step. At the molding step S24 a molded or moldable (plastic) material may be injected into the cavity of the mold. The plastic material may define a plastic component of the to-be-formed stationary blade. The plastic component may be bonded to the metal component, particularly to anchoring elements or anchoring portions thereof. Connecting the metal component and the plastic component may further involve engaging recessed portions at the anchoring portions with the molded plastic material.

A further step S26 may follow which may include removing the at least one slide, if any, from the cavity of the mold. Consequently, the guide slot formed at the stationary blade may be cleared. The guide slot may provide for a defined mating for a to-be-mounted cutter at the stationary blade.

A further step S28 may follow which may be regarded as an optional step. The step S28 may include separating single stationary blades from an array or row including a plurality of stationary blades formed in a mold comprising a plurality of respective molding cavities.

The method of manufacturing a stationary blade according to FIG. 40 may further comprise a step S30 which is directed to providing an intermediate wall. Step S30 may involve providing a sheet metal intermediate wall. The intermediate wall may be adapted to a desired central offset $l_{co}$ between a first wall and a second wall of the stationary blade. The intermediate wall may be formed as a separate part that may be attached to the (semi-finished) stationary blade at a later manufacturing stage. Hence, the method according to FIG. 40 may result in the provision of two separate parts, the (semi-finished) stationary blade and the intermediate wall to be mounted thereto at a later stage. Step S30 may involve, at least in some embodiments, forming an intermediate wall that comprises a guide portion and a retaining portion. Hence, step S30 may involve separately forming and joining the guide portion and the retaining portion. In the alternative, step S30 may involve integrally forming the guide portion and the retaining portion of the intermediate wall.

Figure 41:
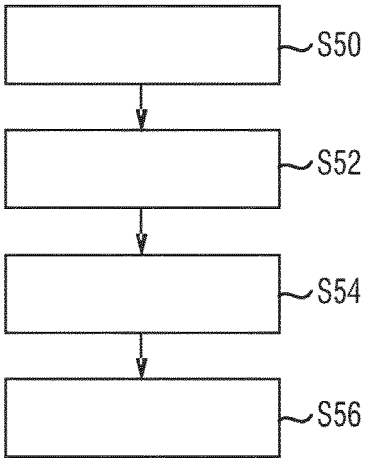
FIG. 41 illustrates a further illustrative block diagram representing several steps of an embodiment of an exemplary method of manufacturing a cutter.

FIG. 41 illustrates an exemplary manufacturing method for a cutter that may be configured to cooperate with a stationary blade of the present disclosure. At a step S50, a precursor for the cutter or a semi-finished cutter may be provided. This may involve providing sheet metal material which may comprise a predefined row or array of a plurality of to-be-processed cutters. A further step S52 may follow that may involve forming a recess or opening at the cutter. The opening may be referred to as guide opening. The guide opening may be adapted to an intermediate wall of the stationary blade, particularly to a guide portion thereof. The guide opening may be arranged as a basically rectangular laterally extending slot in a central portion of the cutter. Generally, the step S52 may include adequate material removing processes, such as cutting, stamping, etching, etc.

A further S54 step may follow which may include forming or processing toothed leading edges of the cutter. The step S54 may further include processing relatively sharp cutting edges at respective teeth of the toothed leading edge. The step S54 may include adequate material-removing processes. By way of example, the step S54 may include an integrated etching step comprising forming a general toothed shape at the toothed leading edge, and forming relatively sharp cutting edges at the teeth. Preferably, the steps S52 and S54 make use of material removing processes that utilize etching (which may be also referred to as chemical milling). It goes without saying that the order of the steps S52 and S54 may be changed. In some embodiments, both steps S52 and S54 may be jointly performed. A further step S56 may follow which may include separating respective cutters from a supporting structure including a row or an array of a plurality of cutters.

According to at least some aspects, the step S54 may further involve processing the cutter so as to define or form at least one scraping portion. The at least one scraping portion comprises at least one tapered scraper profile that typically involves at least one tip edge, or in some embodiments, a first tip edge and a second tip edge. Preferably, at least one or two of the scraping portions are arranged at lateral end surfaces of the guide opening that is formed in step S52. Further scraping portions may be formed at lateral ends of the cutter. In some embodiments, additional slots or openings may be formed at the cutter so as to enable an even greater number of scraping portions. This may involve, in some further embodiments, that recesses are formed that do not extend through the whole vertical dimension (height) of the cutter.

Figure 42:
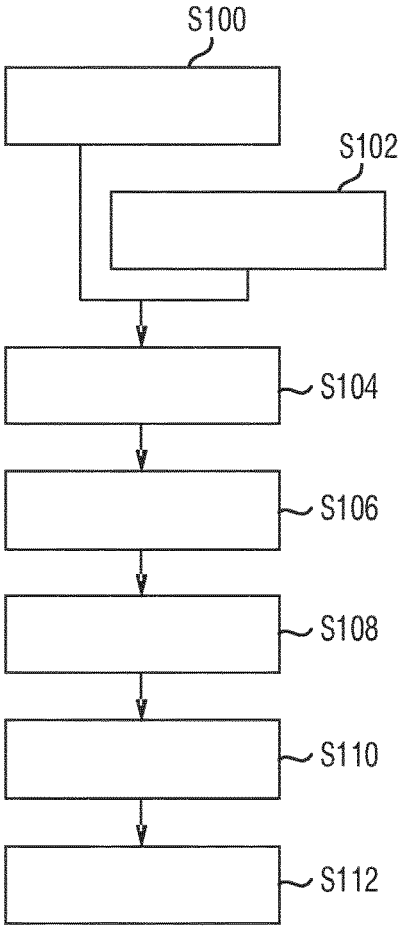
FIG. 42 shows a further illustrative block diagram representing several steps of an embodiment of an exemplary method of manufacturing a blade set.

FIG. 42 illustrates an exemplary manufacturing method for a blade set including a stationary blade and a cutter. The method may include a step S100 comprising providing a stationary blade. The stationary blade may be formed according to the exemplary manufacturing method illustrated in FIG. 40. As indicated above, step S100 may further include providing a (separate) intermediate wall assigned to the stationary blade to be attached thereto at a later step. A further step S102 may include providing a cutter. The steps S100 and S102 may take place in parallel. The step S102 may comprise manufacturing the cutter according to the method illustrated in FIG. 41.

In a further step S104, the intermediate wall and the movable cutter blade may be mated which simplifies the insertion of the components into a guide slot of the (semi-finished) stationary blade. This may involve arranging the intermediate wall, particularly a guide portion thereof, in a guide opening of the cutter. A joining or mating step S106 may follow in which the cutter and the intermediate wall are jointly inserted into the guide slot at the stationary blade. Inserting the cutter and the intermediate wall into the guide slot of the stationary blade may involve laterally inserting the cutter and the intermediate wall through a lateral opening of the stationary blade.

In a further step S108, the intermediate wall may be attached to the stationary blade, particularly to the first wall thereof. Preferably, the intermediate wall is bonded to the first wall, particularly laser-welded and/or sport-welded. Attaching the intermediate wall may include securing the cutter at the stationary blade and, more preferably, setting the longitudinal position and the vertical position (or: height position) of the cutter.

A further step S110 may follow which may involve feeding a transmitting member 70 to the semi-finished assembly of the blade set. The step S110 may particularly involve feeding the transmitting member 70 in a feeding direction that is different from an insertion direction of the cutter. A further step S112 may follow which includes attaching the transmitting member 70 to the cutter 24. The step S112 may further include bonding the transmitting member to the cutter. Bonding may involve welding, particularly laser welding. Attaching the cutter and the transmitting member while both elements are positioned at the stationary blade may also lock the cutter at the stationary blade. This may be also beneficial since in this way no separate fastening or locking components for the cutter are required.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A cutter for a blade set of a cutting appliance, the blade set being arranged to be moved through hair in a moving direction to cut hair, the cutter comprising:

a substantially flat metal main portion;

at least one toothed leading edge protruding from the main portion, the at least one toothed leading edge comprising a plurality of teeth;

a guide opening defined by interior edges of the main portion; and a scraping portion formed by a first one of the interior edges, the scraping portion comprising a tapered scraper profile that tapers as the tapered scraper profile extends towards an opposing second one of the interior edges; the scraping portion extending between third and fourth ones of the interior edges, the third interior edge positioned opposing the fourth interior edge, wherein when the main portion is mounted in the blade set, the scraping portion is arranged to contact a stationary blade of the blade set at a first wall of the stationary blade to scrape off accumulated dirt and debris from the first wall when the cutter moves with respect to the stationary blade during use of the cutting appliance.

2. The cutter as claimed in claim 1, wherein the tapered scraper profile of the scraping portion is arranged as an extending pointed profile comprising a tip edge adjacent to the first wall when the main portion is mounted in the blade set.

3. The cutter as claimed in claim 1, wherein the tapered scraper profile of the scraping portion comprises a cross-section selected from a group consisting of wedge shape, triangle shape, C-shape, double wedge shape, and double triangle shape.

4. The cutter as claimed in claim 1, wherein the tapered scraper profile includes a first tip edge and a second tip edge, wherein the first tip edge is arranged at a first, skin-facing surface of the cutter, and wherein the second tip edge is arranged at a second surface of the cutter that is facing away from the skin during the use of the cutting appliance.

5. The cutter as claimed in claim 1, wherein the scraping portion is a first scraping portion, the cutter comprising a second scraping portion, wherein the second scraping portion is formed by the second interior edge.

6. The cutter as claimed claim 5, wherein at least one of the first and second scraping portions are arranged as an interrupted scraping portion comprising at least two sections, and wherein an inwardly protruding abutment tab is arranged between the at least two sections.

7. The cutter as claimed in claim 1, wherein the scraping portion is one of a plurality of similarly oriented scraping portions that are formed by opposing ones of the interior edges, and wherein an offset between the scraping portions is adapted to a stroke length of the cutter.

8. The cutter as claimed in claim 1, wherein at least one outwardly-facing scraping portion is provided on the main portion adjacent to at least one of the first and second interior edges.

9. The cutter as claimed in claim 1, wherein the scraping portion is one of a plurality of scraping portions that are displaced from one another on the main portion and that have corresponding tapered scraper profiles that extend away from each other.

10. A blade set for a cutting appliance, said blade set being arranged to be moved through hair in a moving direction to cut hair, said blade set comprising:

a stationary blade comprising a first wall arranged to serve as a skin facing wall during the use of the cutting appliance, a second wall at least partially offset from the first wall such that the first wall and the second wall define therebetween a guide slot arranged to receive a cutter, and at least one toothed leading edge formed by the first wall and the second wall, wherein the at least one toothed leading edge comprises a plurality of teeth extending from the first wall and the second wall, and wherein the first wall and the second wall are connected at the at least one toothed leading edge, thereby forming tips of the teeth, and a cutter as claimed in claim 1, said cutter being movably arranged within the guide slot defined by the stationary blade, such that, when the cutter moves with respect to the stationary blade, the at least one toothed leading edge of the cutter cooperates with corresponding ones of the plurality of teeth of the stationary blade to enable cutting of hair caught therebetween in a cutting action.

11. The blade set as claimed in claim 10, comprising an intermediate wall arranged between the first wall and the second wall, wherein the intermediate wall is attached to the first wall and defines a central offset between the first wall and the second wall, and wherein the intermediate wall is sized to fit within the guide opening of the cutter.

12. A method of manufacturing a blade set for a cutting appliance, comprising acts of:

forming a stationary blade comprising a first wall arranged to serve as a skin facing wall during the use of the cutting appliance, a second wall at least partially offset from the first wall, such that the first wall and the second wall define therebetween a guide slot arranged to receive a cutter, wherein the forming the stationary blade further comprises an act of forming at least one toothed leading edge including a plurality of teeth extending from the first wall and the second wall and connecting the first wall and the second wall at an end distal to the first wall and the second wall, thereby forming tips of the teeth;

forming a cutter according to claim 1; and arranging and securing the cutter in the guide slot of the stationary blade.

13. The method as claimed in claim 12, comprising acts of configuring the scraping portion as an interrupted scraping portion comprising at least two sections, and configuring an inwardly protruding abutment tab between the at least two sections.

14. The method as claimed in claim 13, wherein prior to the arranging and securing the cutter, further comprising acts of:

forming an intermediate wall;

positioning the intermediate wall in the guide opening of the cutter;

inserting the cutter and the intermediate wall into the guide slot of the stationary blade; and attaching the intermediate wall to the first wall.

* * * * *